US005585889A

United States Patent [19]

Shishido et al.

[11] Patent Number: 5,585,889

[45] Date of Patent: Dec. 17, 1996

[54] PROCESS CARTRIDGE AND IMAGE FORMING APPARATUS

[75] Inventors: Kazuo Shishido; Hiroo Kobayashi, both of Yokohama; Akira Higeta, Hiratsuka; Hironobu Isobe, Yokohama; Minoru Sato, Yokohama; Shigeo Miyabe, Yokohama; Koji Miura, Sagamihara, all of Japan

[73] Assignee: Canon Kabushiki Kaisha, Tokyo, Japan

[21] Appl. No.: 83,441

[22] Filed: Jun. 29, 1993

[30] Foreign Application Priority Data

| | | | |
|---|---|---|---|
| Jun. 30, 1992 | [JP] | Japan | 4-173264 |
| Jun. 30, 1992 | [JP] | Japan | 4-173271 |
| Jun. 22, 1993 | [JP] | Japan | 5-150639 |

[51] Int. Cl.[6] ..... G03G 21/00

[52] U.S. Cl. ..... 355/200; 355/210

[58] Field of Search ..... 355/200, 210, 355/211, 260, 245; 222/DIG. 1

[56] References Cited

U.S. PATENT DOCUMENTS

| | | | |
|---|---|---|---|
| 4,588,280 | 5/1986 | Ogawa et al. | 355/200 X |
| 4,829,335 | 5/1989 | Kanemitsu et al. | 355/211 |
| 4,873,548 | 10/1989 | Kobayashi et al. | 355/200 |
| 5,028,966 | 7/1991 | Kozuka et al. | 355/260 |
| 5,055,876 | 10/1991 | Matsuoka et al. | 355/211 |
| 5,266,999 | 11/1993 | Yashiro | 355/211 |

FOREIGN PATENT DOCUMENTS

| | | |
|---|---|---|
| 0285139 | 10/1988 | European Pat. Off. . |
| 59-151170 | 8/1984 | Japan . |
| 63-4253 | 1/1988 | Japan . |
| 63-244059 | 10/1988 | Japan . |
| 2-136761 | 6/1990 | Japan . |

*Primary Examiner*—Thu A. Dang

*Attorney, Agent, or Firm*—Fitzpatrick, Cella, Harper & Scinto

[57] ABSTRACT

The present invention provides a process cartridge mountable to an image forming apparatus. The cartridge includes an image bearing member, a processor for acting on the image bearing member, a driving force receiver provided at one end of the image bearing member, a protection member shiftable between a protection position to protect the image bearing member and a retract position, a first projection provided on the side of a toner containing portion, a guide member protruded in the direction perpendicular to the moving direction of the image bearing member, a second projection protruded in the moving direction of the image bearing member, and a third projection protruded from the protection member.

52 Claims, 20 Drawing Sheets

119
3a
7
131
97
71
130
62
52
57
79
98
96
56
55
58
54
53
S
T SURFACE
153
74
73
150
94
61

PROCESS CARTRIDGE AND IMAGE FORMING APPARATUS

BACKGROUND OF THE INVENTION

1. Field of the Invention

The present invention relates to a process cartridge and an image forming apparatus to which such a process cartridge can be mounted. The image forming apparatus may be, for example, an electrophotographic copying machine, a laser beam printer, an LED printer, a facsimile machine or the like.

2. Related Background Art

In the past, various image forming apparatuses using laser light have been put to practical use. In such an image forming apparatus using laser light, a laser light path blocking means is openably arranged in a laser light path to block the laser light path at need. Particularly, in an image forming apparatus having a removable process cartridge including a photosensitive member and at least one process means acting on the photosensitive member, when the cartridge is dismounted from the image forming apparatus, since it is feared that the laser light path is exposed to the outside of the apparatus, thereby leaking the laser light out of the apparatus, such blocking means is effective.

By the way, in order to shift such blocking means, a projection is formed on a frame of the cartridge so that, when the cartridge is mounted to the image forming apparatus, the projection is engaged by the blocking means, thereby shifting blocking means to open the laser light path (refer to the Japanese Patent Application Laid-open No. 59-151170).

On the other hand, the process cartridge is provided with a gear as a driving force receiving means for receiving a driving force from the image forming apparatus when the process cartridge is mounted to the image forming apparatus. When the process cartridge is mounted to the image forming apparatus, the gear of the process cartridge is engaged by a gear of the image forming apparatus, thereby transmitting the driving force from the apparatus to the cartridge (refer to U.S. Pat. No. 4,829,335).

With the arrangement mentioned above, when the process cartridge is mounted to the image forming apparatus, it is desirable to correctly and smoothly engage such gears with each other.

Further, in general, as shown in FIG. 33, the process cartridge 141 is packed in a packing material such as bag 140 made of aluminium deposited polyethylene film, and the cartridge with the bag is enclosed by buffer members 142 made of styrol foam or molded pulp and is stored in a box 143 made of corrugated cardboard. However, when the cartridge is provided with the projection (protruded rib) 144 (FIG. 34), it is feared that the packing material is torn by the projection. Thus, it is desirable to provide a process cartridge which does not tear such packing material.

SUMMARY OF THE INVENTION

An object of the present invention is to provide a process cartridge and an image forming apparatus, in which the process cartridge can be correctly mounted to the image forming apparatus.

Another object of the present invention is to provide a process cartridge and an image forming apparatus, in which a driving force receiving means of the process cartridge can be smoothly engaged by a driving force transmitting means of the image forming apparatus.

A further object of the present invention is to provide a process cartridge and an image forming apparatus, in which a laser shutter of the image forming apparatus can automatically be opened in response to mounting of the process cartridge to the image forming apparatus.

A still further object of the present invention is to provide a process cartridge and an image forming apparatus, in which a protection member of the process cartridge can be retracted to a retract position in response to mounting of the process cartridge to the image forming apparatus.

The other object of the present invention is to provide a process cartridge and an image forming apparatus, in which it is not feared that a packing material is torn.

DETAILED DESCRIPTION OF THE PREFERRED EMBODIMENTS

The present invention will now be explained in connection with embodiments thereof with reference to the accompanying drawings.

Figure 1:
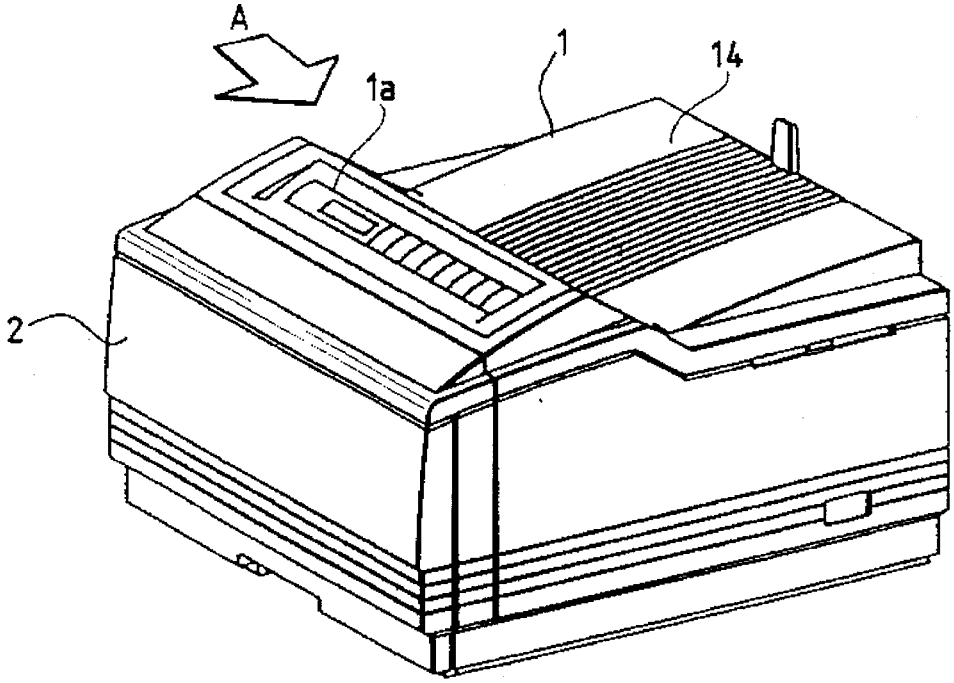
FIG. 1 is a perspective view of an image forming apparatus according to a preferred embodiment of the present invention.
Figure 2:
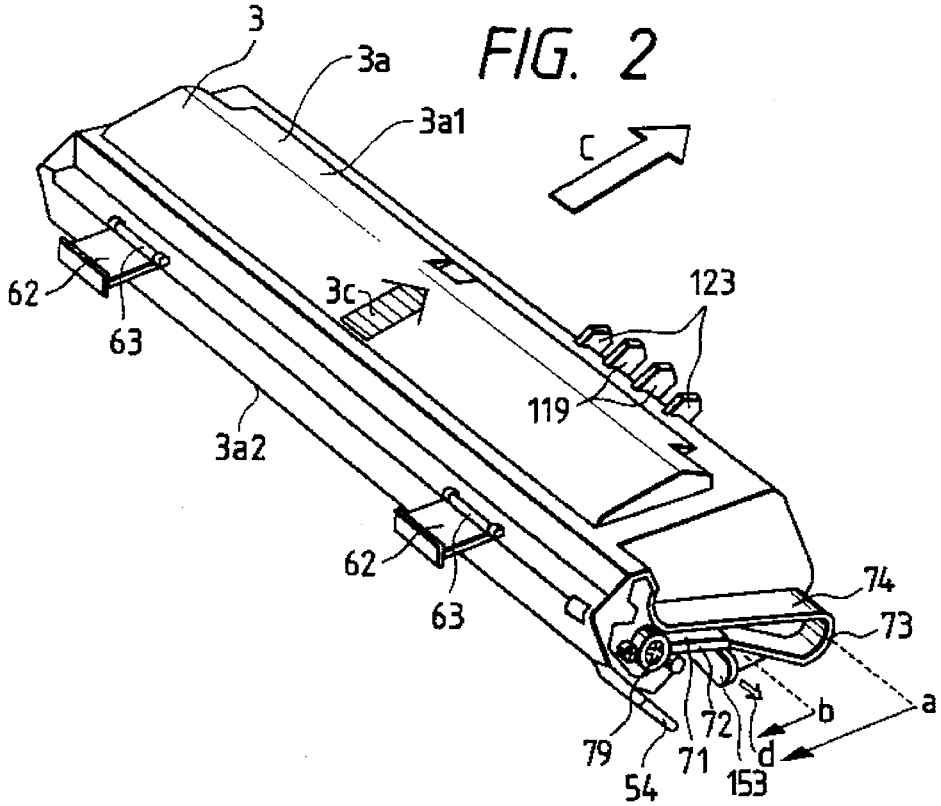
FIG. 2 is a perspective view of a process cartridge according to a preferred embodiment of the present invention.

FIG. 1 is a perspective view of a laser beam printer as an example of an image forming apparatus according to a preferred embodiment of the present invention, and FIG. 2 is a perspective view of a process cartridge 3 which is designed so that it can removably be mounted to the printer 1 by opening a front door 2 of the printer. The process cartridge 3 includes therein an electrophotographic photosensitive drum, a charger means for uniformly charging the electrophotographic photosensitive drum, a developing means for developing a latent image formed on the electrophotographic photosensitive drum, and a cleaning means for removing residual matters remaining on the electrophotographic photosensitive drum. Now, the process cartridge includes, for example, an image bearing member, and at least one of a charger means, a developing means and a cleaning means as a unit which can be removably mounted to the image forming apparatus. Incidentally, in FIG. 1, the reference numeral 1*a* denotes an operation portion of the printer.

Figure 3:
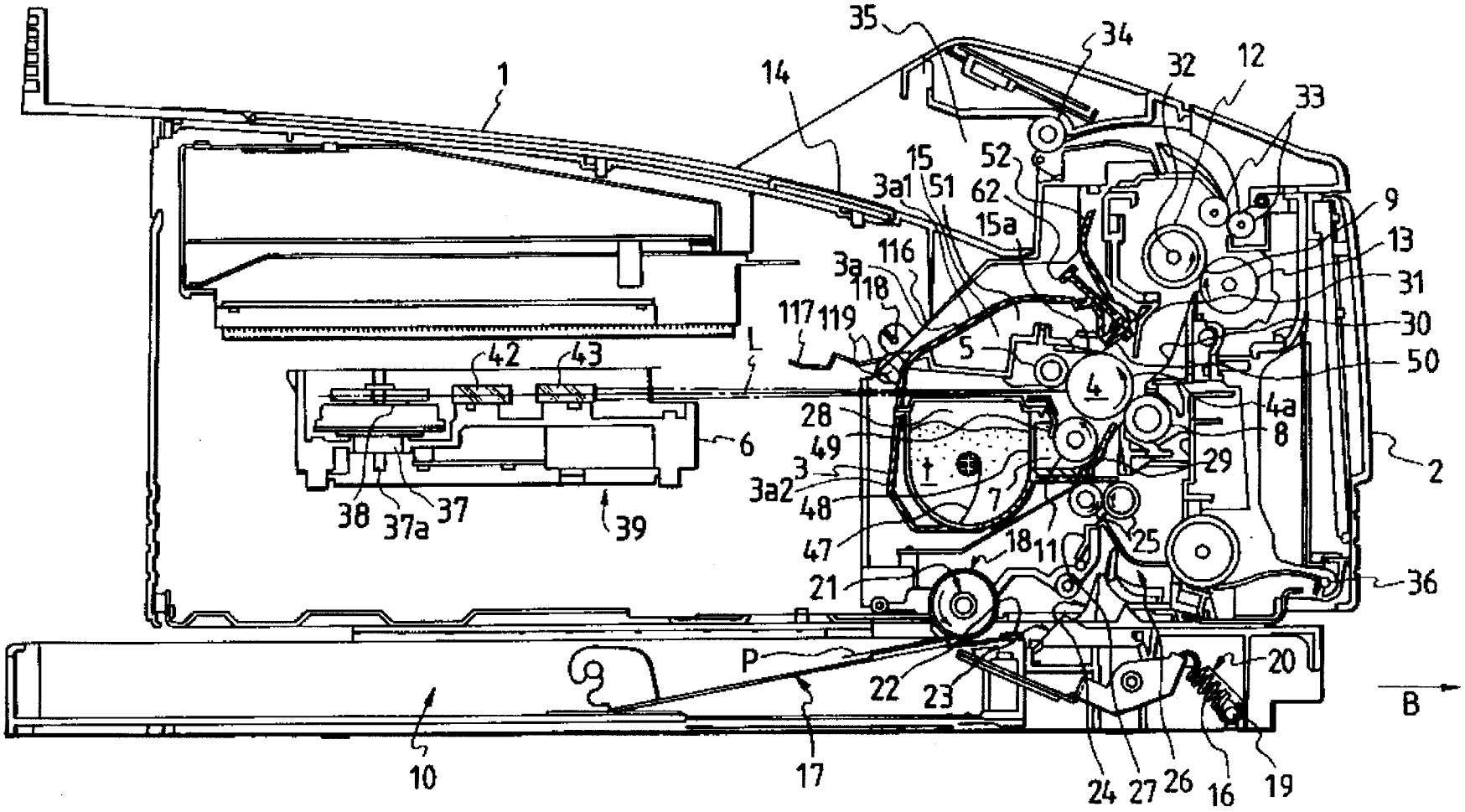
FIG. 3 is a side sectional view of the image forming apparatus to which the process cartridge is mounted.
Figure 4:
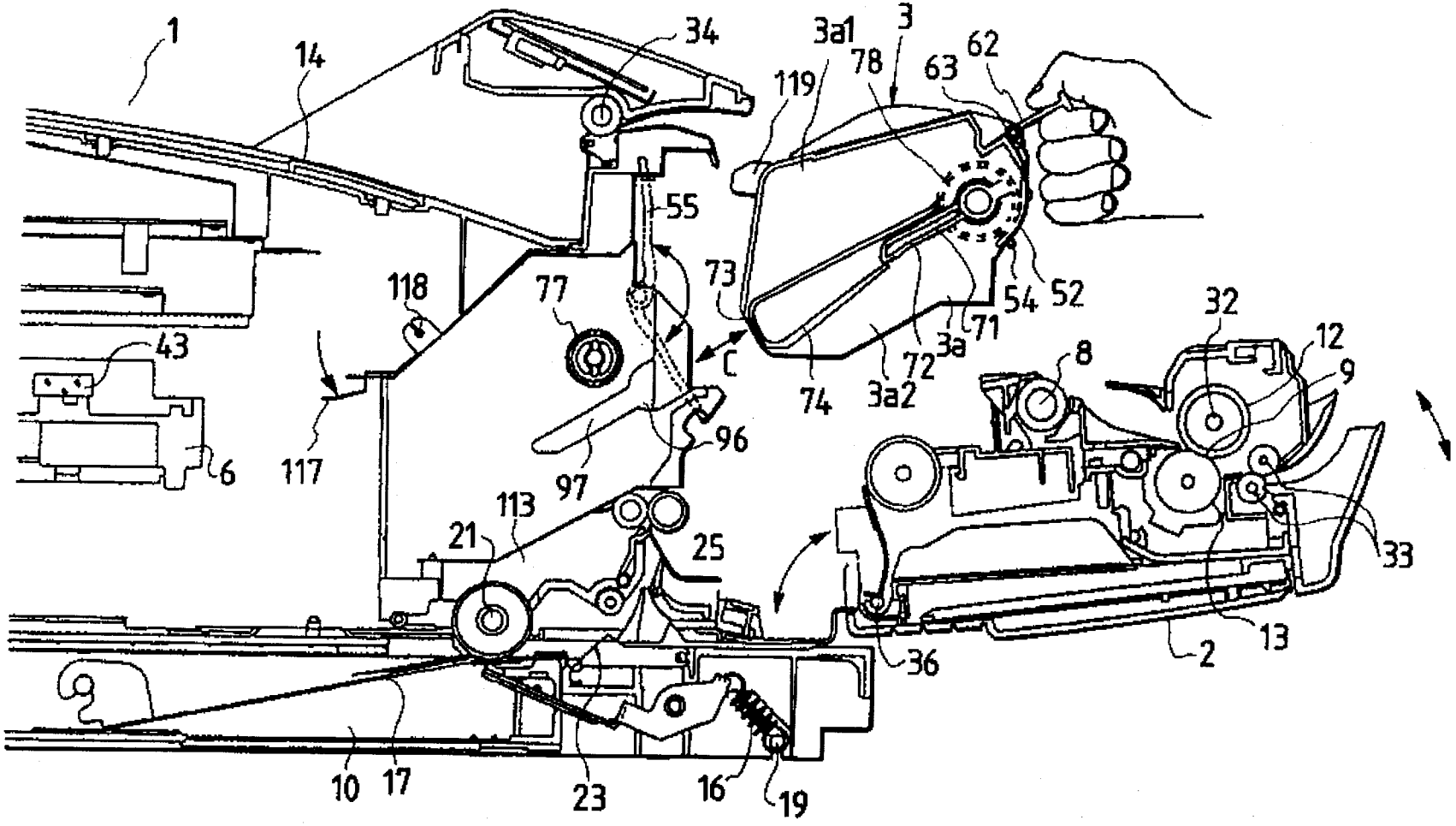
FIG. 4 is a side sectional view showing a condition that the process cartridge is mounted or dismounted with respect to the image forming apparatus.

FIG. 3 is a side view (looked at from a direction shown by the arrow A in FIG. 1) showing a condition that the cartridge 3 is mounted to the printer 1. Further, FIG. 4 is a sectional view showing a condition that the cartridge 3 is being mounted or dismounted in a direction shown by the arrow C. Incidentally, in FIG. 3, an outer wall of the cartridge 3 is shown by the hatched area.

First of all, an image forming process of the laser beam printer as an example of an image forming apparatus will be explained with reference to FIG. 3.

A photosensitive drum 4 having an outer photosensitive layer 4*a* is uniformly charged by a charger roller 5. Incidentally, in the illustrated embodiment, the charger roller 5 is contacted with a peripheral surface of the photosensitive drum 4 and is driven by the rotational movement of the drum. Then, laser light L from a laser optical unit 6 is illuminated onto the photosensitive layer 4*a* in response to image information inputted from a host device such as an external computer. As a result, an electrostatic latent image corresponding to the image information is formed on the photosensitive layer 4*a*. Then, at a developing station 7, a portion of the photosensitive layer 4*a* which has been illuminated by the laser beam L is developed with toner t having the same polarity as the charged polarity of the photosensitive layer 4*a* (inversion development), thereby forming a visualized image on the photosensitive layer 4*a*. Then, in registration with a timing that the visualized image reaches a transfer position between the photosensitive drum 4 and a transfer drum 8, a recording sheet P supplied from a sheet supply cassette 10 is pinched between the photosensitive drum 4 and the transfer drum 8, thereby transferring the visualized image onto the recording sheet P. Then, the recording sheet P is sent to a nip 9 between a pair of fixing rollers 12, 13, where the visualized image is fixed to the recording sheet P. Thereafter, the recording sheet P is discharged onto a discharge tray 14. After the transferring operation, any residual matters such as residual toner remaining on the photo sensitive drum 4 is removed by an elastic cleaning blade 15*a* arranged at a cleaning station 15, thereby preparing for the next charging operation.

Next, a conveying process for the recording sheet P (for example, a recording paper or an OHP sheet) will be explained.

A plurality of recording sheets P are stacked in the sheet supply cassette 10, and an upper front end portion of the sheet stack P is urged against a sheet supply roller 18 by a pivotable sheet stacking plate 17 biased by a tension spring 16. When the recording sheets P are loaded by an operator, the sheet supply cassette 10 is withdrawn to the right (direction shown by the arrow B). In this case, a spring support shaft 19 is shifted upwardly along slide grooves 20 formed in both side walls (at this and that sides) of the sheet supply cassette 10. As a result, since the stacking plate 17 is lowered to a bottom of the sheet supply cassette 10, the recording sheet P can be loaded in the cassette 10 smoothly.

The sheet supply roller 18 is secured to a sheet supply drive shaft 21, and a clutch and solenoid (both not shown) are arranged at an end of the drive shaft 21. With this arrangement, the rotation of the sheet supply roller 18 can be controlled. Separating pawls or claws 22 are formed on the sheet supply cassette at its front corners thereof (in a sheet supplying direction), and a pivotable cassette inlet guide 23 is arranged in front of the cassette and is biased by a spring (not shown). Further, a guide portion 24 for guiding the recording sheet P from the sheet supply cassette 10 is formed on the frame of the printer, which guide portion serves to direct the recording sheet P to a pair of regist rollers 25.

The solenoid (not shown) is turned ON in response to a sheet supply start signal, a driving force of a sheet supply drive gear (not shown) is transmitted to the drive shaft 21 via the clutch (not shown), with the result that the sheet supply roller 18 is rotated, thus directing the recording sheet P to the cassette inlet guide 23. In this case, due to the relation of friction of coefficient, only an uppermost recording sheet P is supplied. Thereafter, the recording sheet P is sent to a nip of the paired regist rollers 25 by the rotation of the sheet supply roller 18.

On the other hand, in the illustrated embodiment, the printer 1 has a second inlet 26 for receiving a recording sheet P supplied from any means other than the sheet supply cassette 10. With this arrangement, in addition to the sheet supply cassette 10, sheet decks or other sheet supply cassettes can be provided at a lower portion of the printer optionally, thereby increasing the flexibility of the printer.

A sensor lever 27 is arranged at an upstream side of the paired regist rollers 25 in a sheet conveying direction. The sensor lever 27 is pivotally mounted on the frame of the printer and is used to detect a leading end of the recording sheet P by a photo-interrupter and the like. After the leading end of the recording sheet P is detected, the recording sheet P is sent between the photosensitive drum 4 and the transfer roller 8 by the rotation of the regist roller pair 25 in registration with a tip end of the visualized image on the photosensitive drum 4.

A plurality of longitudinal guide ribs 29 are formed on a surface of a toner containing portion 28 arranged at the developing station 7. During the conveyance of the recording sheet P, the recording sheet P can be conveyed with respect to the photosensitive drum 4 with high accuracy by guiding the recording sheet P by the guide ribs 29. Thereafter, the visualized image (toner image) formed on the photosensitive drum 4 is transferred onto the recording sheet P by the transfer drum 8 urged against the photosensitive drum 4 with a predetermined pressure, by an image forming process which will be described later. In this case, a DC bias voltage of about 500 to 2000 V having the polarity opposite to that of the toner is applied to the transfer drum 8, thereby electrostatically adhering the toner to the recording sheet P.

As a means for separating the recording sheet P from the photosensitive drum 4 after the transferring operation, a charge removing probe (not shown) is embedded to a leading end (upstream side) of a fixing inlet guide 30, thereby smoothly separating the recording sheet P even when a recording sheet which is difficult to separate is used. Thus, it is possible to prevent the adhering of the recording sheet P around the photosensitive drum 4 due to the poor separation. Further, if the poor separation should occur, since a penetration preventing guide 31 is disposed in a confronting relation to the fixing inlet guide 30, it is possible to avoid the serious sheet jam.

The recording sheet P to which the image was transferred is directed to the fixing station 9 by the inlet guide 30. The fixing station 9 has a fixing roller 12 having a halogen heater 32 as a heat source therein, and a pressure roller 13 abutted against the fixing roller with a predetermined pressure and driven by a drive gear (not shown). A temperature of the fixing roller 12 is detected by a thermistor (not shown) contacted with the surface of the fixing roller 12 so that the temperature is controlled by a controller (not shown) of the printer 1. Further, in order to prevent the overheat of the halogen heater 32, a thermo-switch (not shown) of non-contact type is arranged above the fixing roller 12.

The recording sheet P passes through a nip between the fixing roller 12 and the pressure roller 13. Meanwhile, the toner image on the recording sheet P is fixed to the recording sheet. After the fixing operation, the recording sheet P is separated from the fixing roller 12 by a separating pawl (not shown), and then is conveyed upwardly by a pair of tension rollers 33 disposed above the fixing roller 12. In this case, the tension rollers 33 are rotated at a relative speed faster than the fixing roller 12 by several percentages so that the recording sheet P is conveyed while being pulled forcibly, thereby preventing the occurrence of the curl and/or wrinkles in the recording sheet P. Thereafter, the recording sheet P is discharged out of the printer and onto the discharge tray 14 disposed at a discharge opening 35 by a pair of discharge roller 34.

The above-mentioned transfer roller 8, fixing station 9, tension rollers 33 and the like are mounted on the front cover 2 so that they are rotatably mounted on the printer 1 by a shaft 36. The front cover 2 can be opened when it is rotated in a clockwise direction in FIG. 4 and can be closed when it is rotated anticlockwise direction. Accordingly, the front cover 2 can be opened and closed with respect to the frame of the printer.

Figure 5:
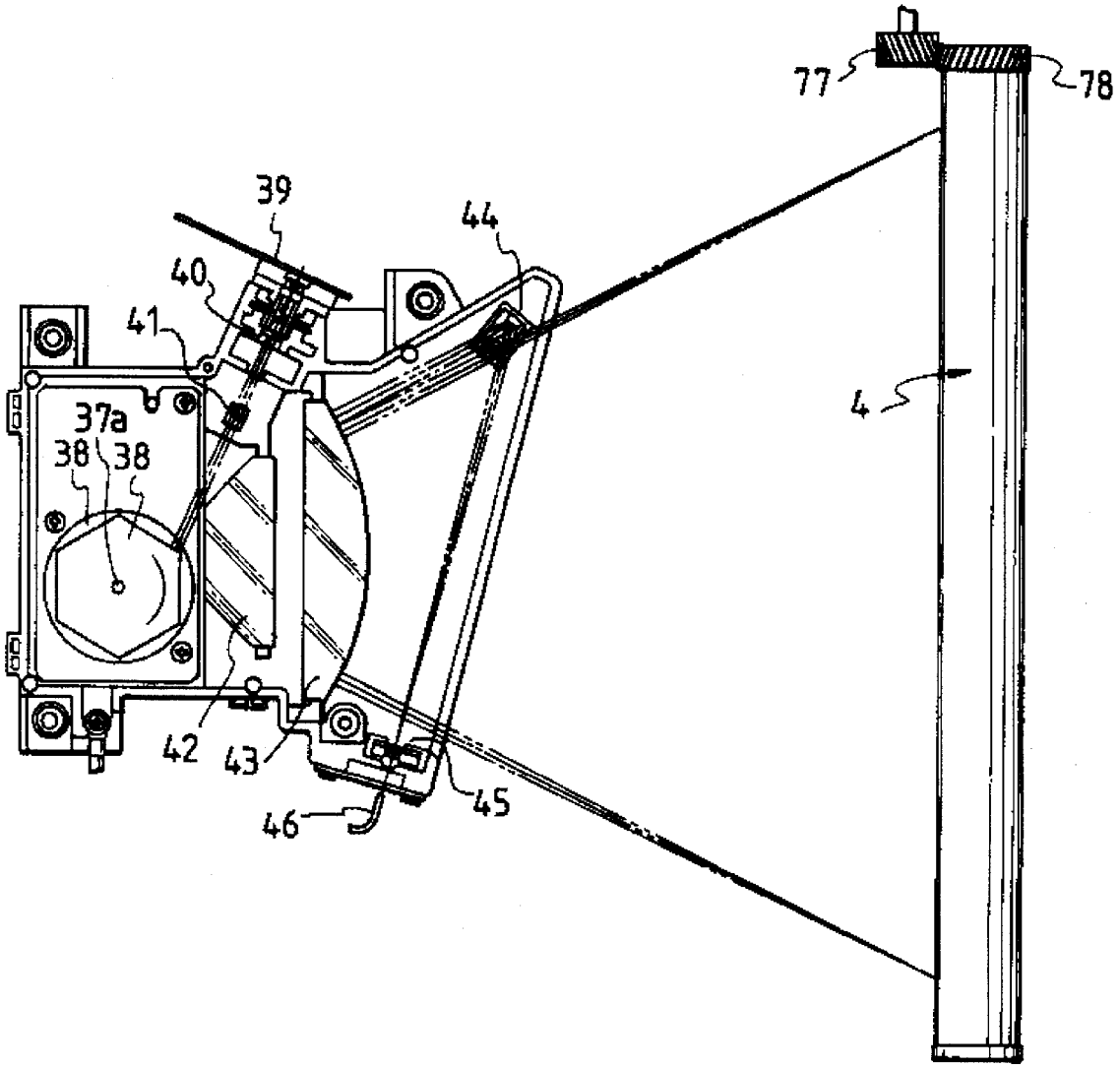
FIG. 5 is a plan view showing a laser scanner and laser light paths.

Next, an image forming portion of the laser optical system will be explained with reference to FIGS. 3 and 5.

A polygon mirror 38 is secured to a rotary shaft **37*a* of a polygon motor 37 which is rotated at a high speed. The laser light L emitted from a laser unit 39 passes through a collimator lens 40 and a cylindrical lens 41, and then is reflected by the polygon mirror 38 so that the laser light beams are focused onto the photosensitive drum 4 via a spherical lens 42 and an Fθ lens 43**.

The laser light L scans along a generatrix direction of the photosensitive drum 4 by the rotation of the polygon mirror 38, so that portions illuminated by the laser light L are charged at the predetermined potential by ON/OFF control of the laser unit 39, thereby forming the electrostatic latent image on the photosensitive drum. In this case, in order to provide the reference with respect to the laser scan along the generatrix direction (referred to as "main scan" hereinafter) effected by the polygon mirror 38, a BD mirror 44 is arranged at a position out of an image area at the beginning point of the main scan. After the laser light L is reflected by the BD mirror 44, the laser light is directed to a laser receiving surface 45 disposed at a position substantially equivalent to the photosensitive drum 4. Thereafter, the laser light L is directed to a laser light receiving element (not shown) of a DC controller (not shown) by an optical fiber 46 arrange at the laser light receiving surface 45.

With this arrangement, by directing the laser light beams as mentioned above, the reference timing of the laser scan is obtained from the image output timing, and an image signal is outputted to the laser unit 39 by the clock on the basis of the reference timing, thereby effecting the scan in the min scan direction. The above-mentioned polygon motor 37 and optical elements such as mirrors and lenses are housed in the scanner unit 6 which is positioned on the printer with high accuracy.

Next, the process cartridge 3 constituting the image forming station will be explained.

Incidentally, in the illustrated embodiment, the process cartridge 3 has the frame 3 comprising an upper frame **3*a*1 and a lower frame 3*a*2. The photosensitive drum 4, cleaning station 15, charger roller 5 and charge bias contact 132 are attached to the upper frame 3*a*1, and the developing station 7, toner containing portion 28, developing bias contact 133 and toner remaining amount detection contact 134 are attached to the lower frame 3*a*2. The upper and lower frames 3*a*1, 3*a*2 are pulled each other by a tension spring 150 (FIG. 31) so that the photosensitive drum 4 is spaced apart from the developing roller 11** by a predetermined distance.

When the process cartridge 3 is mounted to the printer 1, although the electrophotographic process is used to perform the image formation, the process cartridge 3 will be briefly described in accordance with this electrophotographic process.

A primary charger station is arranged at an upstream side of a position where the laser light L is illuminated onto the photosensitive drum. In the illustrated embodiment, in the charger station, the charger roller 5 made from a semiconductor elastic body which is rotatingly driven is abutted against the photosensitive drum 4 with a predetermined pressure. For example, the charger roller 5 can uniformly charge the surface of the photosensitive drum 4 at a voltage of −600 to −700 V by applying the bias comprising DC voltage of −600 to −700 V and AC voltage of 1200 to 1800 V to the charger roller.

Then, the formation of the electrostatic latent image is effected by the laser beam optical system, and the potential of the electrostatic latent image is changer to −50 to −150 V.

On the other hand, the toner having the polarity same as that of the primary charge is picked up from the toner container 28 by an agitating member 47 and then is sent to the developing station 7 through an opening 48. A thin toner layer is formed on the surface of the developing sleeve 11 by frictionally charging the toner due to the sliding contact between the toner and a developing blade 49. By applying AC developing bias to the developing sleeve 11 spaced apart from the photosensitive drum 4 by a distance of 200 to 350 μm, the toner t is inversion-developed (jumping development) in accordance with the electrostatic latent image, thereby developing the latent image as a toner image (visualized image) on the photosensitive drum 4. Incidentally, the reference numeral 153 denotes a gripper for peeling a toner seal (not shown). Before the process cartridge 3 is used, by pulling the gripper 153 (in a direction shown by the arrow D), the toner in the toner container 28 can be supplied to the developing station 7 through the opening 48.

As mentioned above, the toner image on the photosensitive drum 4 is transferred onto the recording sheet P by the bias of the transfer drum 8.

On the other hand, the residual toner remaining on the photosensitive drum 4 passes through a dip sheet 50 (formed from a PET sheet having a thickness of 50 to 100 μm) and is scraped by the cleaning blade 15*a* to be collected into a cleaning container 51. The cleaned photosensitive drum 4 is prepared for the next image format ion.

The process cartridge 3 is exchanged by a new one after a predetermined number of image formation, in consideration of the fact that the endurance service lives of various process members (for example, photosensitive drum, cleaning blade, charger roller and the like) are expired or the toner is used up. When the process cartridge 3 is exchanged, the process cartridge can be withdrawn toward the front door 2 after the latter is opened. That is, when the front door 2 is opened, the process cartridge 3 can be withdrawn out of the printer in a direction perpendicular to the generatrix direction of the photosensitive drum 4. Further, after a new process cartridge 3 is mounted to the printer 1, by closing the front door 2, the process cartridge 3 is positioned to a predetermined position where the photosensitive drum is abutted against the transfer drum 8.

Figures 6A, 6B:
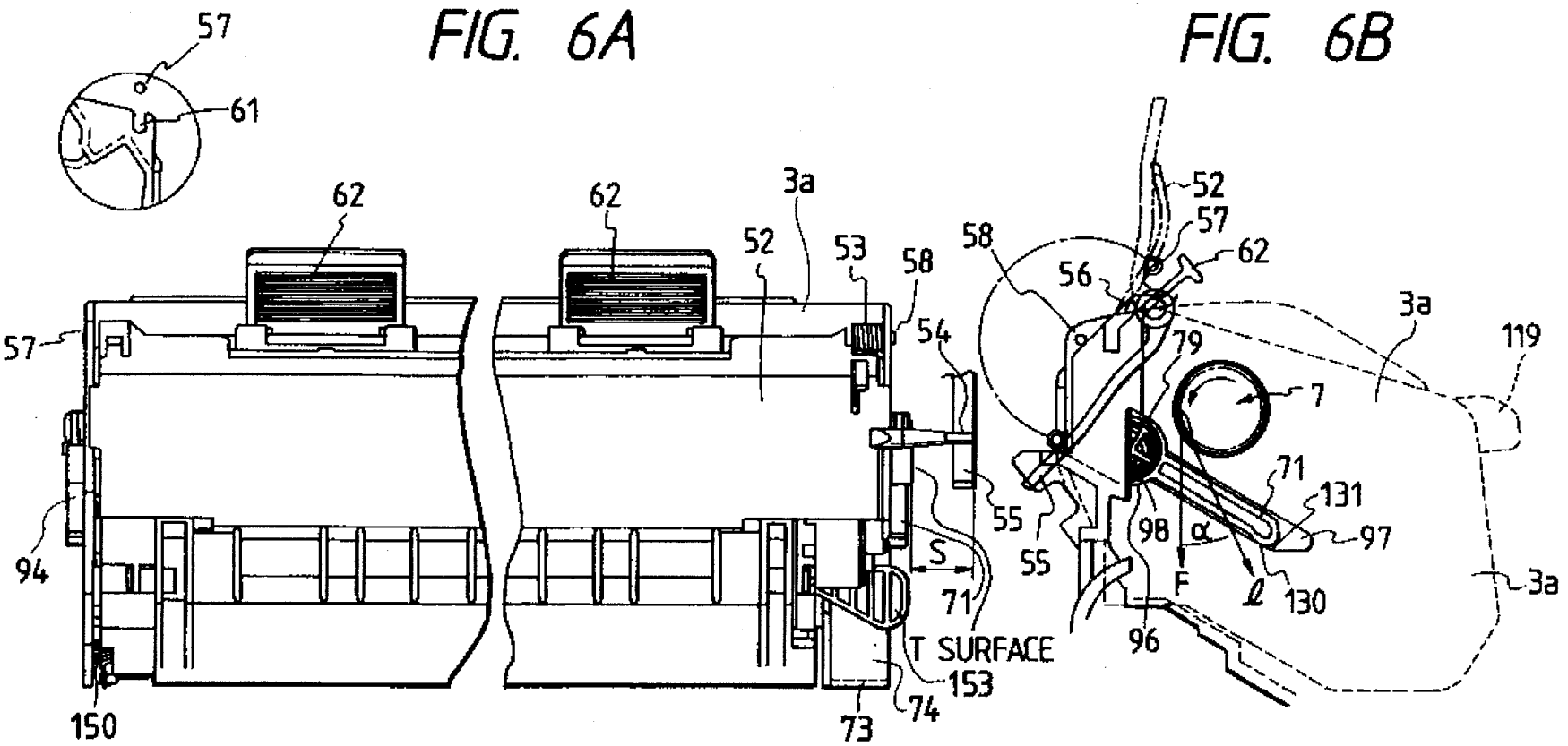
FIG. 6A is a front view of the process cartridge.
FIG. 6B is a side view of the process cartridge.
Figure 7:
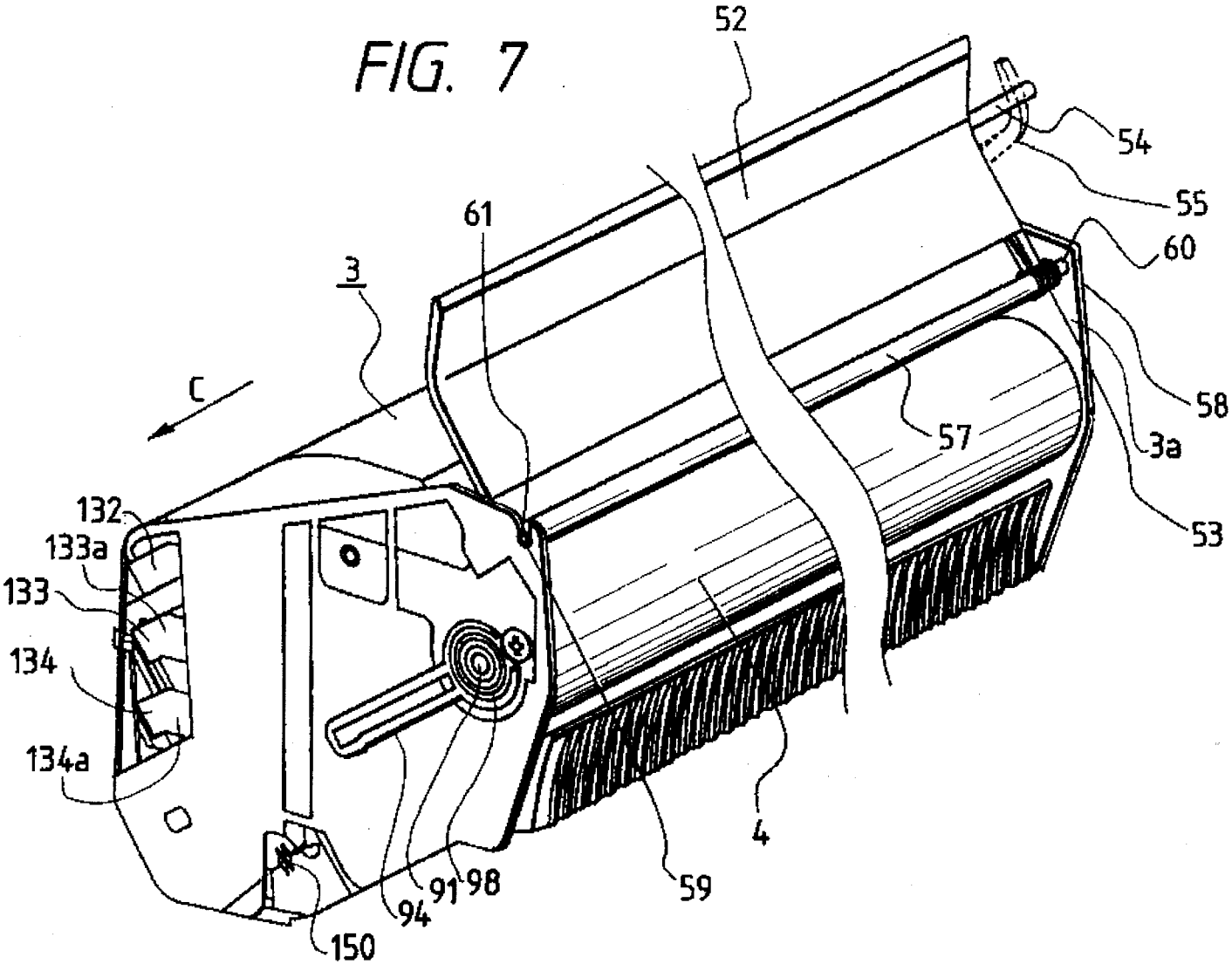
FIG. 7 is a perspective view showing a condition that a drum cover of the process cartridge is opened.

By the way, if the photosensitive drum 4 is exposed to external light for a long time, it will be deteriorated, and if the foreign matters are adhered to the surface of the photosensitive drum or if the surface of the photosensitive drum is damaged, the poor image will occur. In the illustrated embodiment, as shown in FIGS. 1, 3, 6 and 7, a drum shutter (cover) 52 is pivotally mounted on the frame 3*a* of the process cartridge 3, which drum shutter can be shifted between a first position where an exposed portion (transfer area) of the photosensitive drum 4 is covered by the drum shutter and a second position retarded from the first position. Incidentally, FIGS. 6A is a front view of the process cartridge 3 when the drum shutter 52 is positioned at a front side, and FIG. 6B is a side view of the process cartridge, and FIG. 7 is a perspective view of the process cartridge showing a condition that the drum shutter 52 is opened. In a condition that the process cartridge is dismounted from the printer 1 or in a condition that the process cartridge is mounted to the printer 1 and the front door 2 is opened, the drum shutter 52 is closed by a shutter spring 53 (first position). A drum shutter pin 54 comprising a rod-shaped arm member is protruded from an end of the drum shutter 52, which shutter pin can be engaged by a shutter open lever 55 formed on the printer 1. The shutter open lever 55 is rotated around a pivot 56 in response to the opening/closing movement of the front door 2. In the condition that the process cartridge 3 is mounted to the printer 1, when the front door 2 is closed, the shutter open lever 55 is rotated so that the lever 55 is engaged by the shutter pin 54, thereby opening the drum shutter 52 (second position). That is, the shutter pin 54 is disposed at a position at a side of a drum gear 78 with respect to a direction perpendicular to a rotational direction of the photosensitive drum 4 and is protruded from the drum shutter 52 in a direction perpendicular to the rotational direction of the photosensitive drum 4.

The drum shutter 52 is rotatable (openable) around a rotary shaft 57. The rotary shaft 57 is rotatably supported by pivot supports 58, 59 arranged at both longitudinal ends of the photosensitive drum 4. One of the pivot supports 58 has a circular fitting hole 60, and the other pivot support 59 has a slitted fitting hole 61. When the shutter drum 52 having the rotary shaft 57 is attached to the frame 3*a* of the cartridge, one end of the rotary shaft 57 is firstly inserted into the circular fitting hole 61, and then the other end of the rotary shaft is fitted into the hole 61 through the slit. Since one pivot support has the circular fitting hole and the other pivot support has the slitted fitting hole as mentioned above, it is possible to prevent the inadvertent dropping out of the drum shutter 52 from the cartridge frame 3*a* and to facilitate the assembling of the drum shutter.

Particularly, as shown in FIGS. 6A and 6B, a driving force receiving portion (for example, a helical gear 78) provided on the end of the photosensitive drum 4 for receiving a driving force from the printer 1 is subjected to a force F in a direction inclined by a pressure angle α with respect to a tangential line 1 of a reference pitch circle, by the driving of a drive gear (helical gear 77) of the printer 1. Thus, when the circular fitting hole 60 is arranged at the side near the driving force receiving portion (helical gear), even if the force is generated in a direction that the drum shutter pin 54 tends to separate from the cartridge 3 due to the force F, it is not feared that the drum shutter 52 is separated from the cartridge.

Further, the drum shutter 52 is biased by the shutter spring 53 to be rotated in one direction, and the shutter spring 53 is assembled at a position near the drum shutter pin 54, i.e., in a boss 57 including the hole 60. With this arrangement, in comparison with a case where the shutter spring 53 is assembled at the opposite side (near the hole 61), it is possible to considerably reduce the torsion amount of the drum shutter 52 when the drum shutter 52 is completely opened. Accordingly, it is possible to prevent the inconvenience (interference between parts, plastic deformation of parts) due to the torsion.

Further, in the illustrated embodiment, a length S of the drum shutter pin 54 of the drum shutter 52 is so selected that it becomes shorter than 19 mm from a thrust reference surfact T of the process cartridge 3. With this arrangement, it is possible to prevent the enclosing bag for the process cartridge 3 from tearing. If S≧19 mm, since the packing material is torn by the dropping test, a special packing must be provided, thus increasing the cost.

By the way, in the illustrated embodiment, while the shafts were provided on both ends of the drum shutter 52, shafts may be provided on the process cartridge 3, and holes may be formed in the ends of the drum shutter 52. Further, it should be noted that the combination of shaft and hole may be adopted.

The mounting and dismounting operation of the process cartridge 3 with respect to the printer is effected by gripping the gripper portions 62 provided on the frame 3*a* of the process cartridge 3 by the operator. The gripper portions 62 are arranged at the left and right in the longitudinal direction, respectively, above the photosensitive drum 4 and are rotatably attached to the process cartridge 3. When the drum shutter 52 is rotated in the opening direction, the gripper portions 62 are also rotated upwardly while being pushed by the shutter 52 to a position where the gripper portion do not interfere with the process elements in the printer. The operator holds the gripper portions 62 and sets the process cartridge into a installation portion 113 (for the process cartridge 3) formed within the frame of the printer. The setting operation for the process cartridge 3 can be effected correctly by using a positioning and guiding mechanism which will be described hereinbelow.

As shown in FIG. 2, substantially arcuated flange portions 79 for positioning the process cartridge 3 with respect to the printer 1, and guide rib portions 71 for preventing the inclination of the process cartridge 3 and for guiding the process cartridge when the cartridge is mounted to the printer are provided on the frame 3*a* of the process cartridge 3 on both sides of the photosensitive drum 4. Further, the longitudinal both ends of the photosensitive drum 4 are supported by the frame 3*a* of the cartridge by drum positioning pins 98. The drum positioning pins 98 are inserted into positioning holes coaxial with the arcuated flange portions 79 and are secured therein. On the other hand, elongated guide holes 97 for guiding the guide rib portions 71 and for regulating the inclination of the process cartridge 3, and arcuated positioning portions 96 for positioning the process cartridge 3 are formed in the printer (FIG. 6B).

In this way, since the guide rib portions 71 of the process cartridge 3 are guided by the guide holes 97 of the printer and the flange portions 79 of the process cartridge 3 are engaged by the positioning portions 96 of the printer 1, the photosensitive drum 4 is positioned with respect to the printer 1 with high accuracy. As mentioned above, since the photosensitive drum 4 is secured in the positioning holes coaxial with the flange portions 79, the process cartridge 3 is positioned with respect to the printer 1 in connection with the photosensitive drum 4.

Accordingly, after the guide rib portions 71 of the process cartridge 3 are inserted into the guide holes of the printer 1, when the operator pushes the process cartridge into the interior of the printer 1, the process cartridge 3 can easily be mounted in the mounting position 113 of the printer 1 with high accuracy. Incidentally, as an auxiliary guide means when the process cartridge is mounted to the printer 1, an arrow 3*c* is marked on a top surface of the process cartridge 3 at a central portion thereof (FIG. 12); on the other hand, a target mark c is formed on the printer 1 above the process cartridge insertion inlet 1*b* at a central portion thereof, so that the mounting ability of the process cartridge 3 is improved by aligning the arrow 3*c* with the target mark c.

By the way, as shown in FIGS. 3 and 4, a laser shutter 117 is pivotally attached in holes 118 formed in an inner cover 116 of the printer 1. When the process cartridge 3 is not mounted to the printer 1, the laser shutter 117 is lowered (to a condition shown in FIG. 4) by its own weight, thereby closing the laser light path. Accordingly, if the laser light L is illuminated by the erroneous operation, the laser light is blocked by the closed laser shutter 117, thereby preventing the laser light L from leaking out of the printer 1.

On the other hand, laser shutter ribs 119 for actuating the laser shutter 117 of the printer 1 are formed on the frame 3*a* above the cleaning means of the process cartridge 3 (front end of the cartridge 3 in the cartridge mounting direction). When the process cartridge 3 is mounted to the printer, the laser shutter 117 is pushed upwardly (condition shown in FIG. 3) by the laser shutter ribs 119, thereby opening the laser light path.

Figure 23:
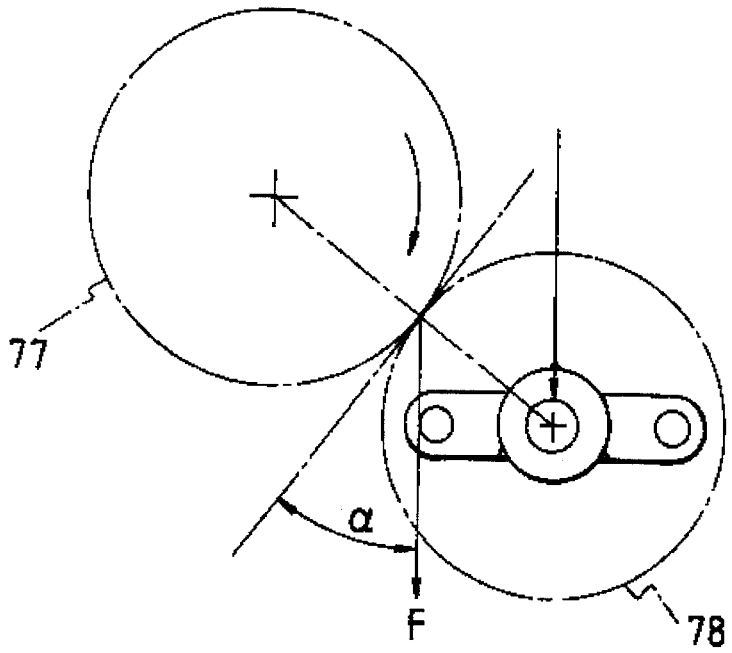
FIG. 23 is a view showing a force applied to the image forming apparatus to which the process cartridge is mounted, when the image forming apparatus is driven, according to another embodiment.

Further, the driving of the photosensitive drum 4 is effected by engaging a drum gear 78 adhered and secured to the end of the photosensitive drum 4 by a drum drive gear 77 rotatably supported by a side portion of the printer 1 when the process cartridge 3 is positioned in the predetermined mounting position 113 of the printer 1. When the drive motor (not shown) of the printer 1 is rotated, the drum drive gear 77 is rotated via a motor gear, idler gears and a clutch gear (all of which are not shown), thereby transmitting a driving force to the drum gear 78 meshed with the drive gear 77, with the result that the photosensitive drum 4 is rotatingly driven, thus effecting the above-mentioned image formation. In this case, as shown in FIGS. 6A, 6B and 23, a direction of a meshing force F acting on the surface of a tooth of the drum gear 78 is offset from a perpendicular line 1 regarding a straight line connecting between centers of the drum gear 78 and the drum drive gear 77 by a pressure angle α for the engagement between the gears. The meshing force F is directed toward the mounting direction of the process cartridge 3 to the printer.

Accordingly, when the drum drive gear 77 is rotated, the flange portions 79 of the process cartridge 3 are urged against the positioning portions 96 of the printer by the meshing force F. As a result, if the flange portions 79 of the process cartridge 3 is deviated from the positioning portions 96 of the printer when the process cartridge is mounted to the printer, as the photosensitive drum 4 is driven, the process cartridge is shifted in the thrust direction, thereby engaging the flange portions 79 by the positioning portions correctly.

Further, an anti-clockwise moment for rotating the process cartridge around the photosensitive drum 4 is generated in the process cartridge 3 by the meshing force F. As a result, supporting surfaces 130 of the guide rib portions 71 of the process cartridge 3 are urged against receiving surfaces 131 of the guide holes 97. Consequently, if the supporting surfaces 130 of the guide rib portions 71 of the process cartridge 3 are floated above the receiving surfaces 131 of the guide holes 97 of the printer 1 when the process cartridge is mounted to the printer, as the photosensitive drum 4 is driven, the supporting surfaces 130 are closely contacted with the receiving surfaces 131 properly.

On the other hand, when the process cartridge 3 is dismounted from the printer 1, first of all, the front door 2 is opened. When the front door 2 is opened, the drum drive gear 77 is disengaged from gears connected to the drive motor (not shown) by a link mechanism (not shown), with the result that the drum drive gear 77 can be freely rotated with respect to the gears of the printer 1. Therefore, the meshing force F is disappeared, and the process cartridge 3 can be dismounted from the printer 1 smoothly.

Figure 31:
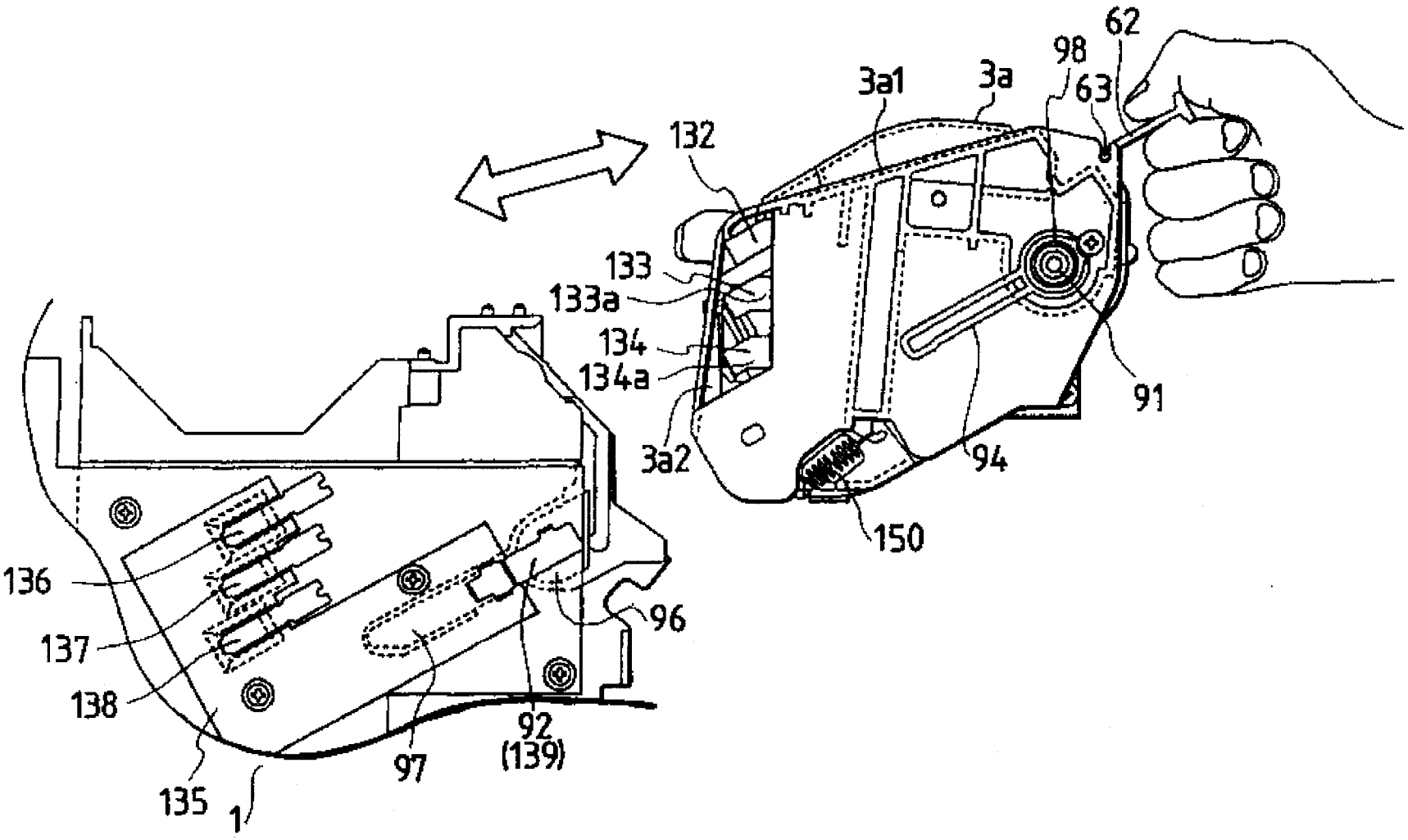
FIG. 31 is a side view showing electric contacts of the process cartridge and of the image forming apparatus.

Next, electrical connection between the process cartridge 3 and the printer 1 will be explained. As shown in FIG. 31, a charge bias contact 132, a developing bias contact 133 and a toner amount information contact (toner remaining amount detection contact) 134 are arranged on an outer surface of the process cartridge 3 at a side opposite to the drum gear 78 with respect to the longitudinal direction (thrust direction) of the photosensitive drum 4, and these contacts 132, 133, 134 are spaced apart from each other by a predetermined distance. Further, a cylindrical (having a diameter of about 2–3 mm) electrode 91 for earthing the drum is protruded from the drum positioning pin 98 laterally.

These contacts are formed from electrically conductive members which will be described later. Regarding the vertical direction, the charge bias contact 132 for receiving the bias to be applied to the charger roller 5 from the printer 1 is arranged at an uppermost position, the developing bias contact 133 for receiving the bias to be applied to the developing roller 11 from the printer 1 is arranged at an intermediate position, and the toner amount information contact 134 for informing the printer 1 of the remaining amount of toner in the toner container 28 (i.e., the fact that the toner amount in the toner container 28 is decreased below a predetermined value) is arranged at a lowermost position. Incidentally, when the printer 1 receives a signal via the toner amount information contact 134, a lamp (not shown) provided on the operation portion la is turned ON, thereby informing the operator of the fact that the remaining amount of the toner is decreased. The above-mentioned contacts are arranged substantially in parallel with each other, and, as shown in FIG. 31, the charge bias contact 132 has a substantially rectangular shape, and the developing bias contact 133 and the toner amount information contact 134 have substantially the same shapes so that bases 133*a*, 134*a* of these contacts 133, 134 are enlarged in a widthwise direction. A distance between the charge bias contact 132 and the developing bias contact 133 is about 3 to 4 mm, and a distance between the developing bias contact 133 and the toner amount information contact 134 is about 5 to 6 mm. Incidentally, the charge bias contact 132 is attached to the upper frame 3al of the process cartridge 3, and the developing bias contact 133 and the toner amount information contact 134 are attached to the lower frame 3*a*2.

On the other hand, a high voltage substrate 135 is attached to the inner side surface of the printer 1. A charge bias contact 136 of the printer, a developing bias contact 137 of the printer and a toner amount information contact 138 of the printer are arranged on the high voltage substrate 135 for electrical connection to the process cartridge 3. When the high voltage substrate 135 is attached to the printer 1, these contacts are protruded inwardly from the side wall of the printer 1 through corresponding openings.

When the process cartridge 3 is mounted to the printer 1, the respective contacts are contacted with each other, thus completing the electrical connection between the process cartridge and the printer. As mentioned above, it is desirable to make the contacts of the process cartridge 3 from the same material or same group of material as that of the contacts of the printer 1. In the illustrated embodiment, all of the contacts on the high voltage substrate 135 each is made from a bronze phosphite plate electroplated by KN, and the charge bias contact developing bias contact and toner amount information contact of the process cartridge 3 each is made from a stainless steel plate, and the electrode of the drum earth is made from a steel plate electroplated by KN.

Figure 8:
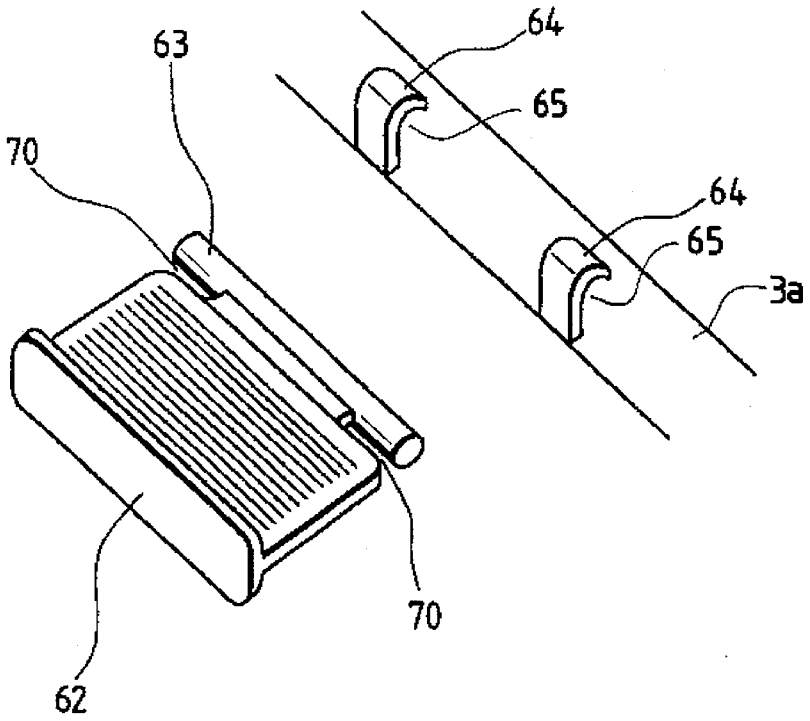
FIG. 8 is a perspective view showing a gripper portion of the process cartridge.

Next, the gripper portions 62 of the process cartridge 3 will be explained with reference to FIGS. 8 and 9.

A shaft 63 as a pivot shaft is integrally formed with each gripper portion 62. Further, hinge portions 64 are formed on the cartridge frame 3*a*. Further, each hinge portion 64 has an opening portion 65, so that the gripper portion 62 can be attached to the hinge portions 64 by inserting the shaft 63 through the opening portions 65. A gap of the opening portion 65 is slightly smaller than a diameter of the shaft 63, so that the gripper portion 62 is attached to the hinge portions 64 while elastically deforming the latter. In a condition that the gripper portion 62 is attached to the hinge portions, the gripper portion 62 can be lightly rotated around the hinge portions 64. When the process cartridge 3 is dismounted from the printer 1, the gripper portions 62 are pulled in a direction shown by the arrow C (FIGS. 4 and 9). In this case, since the opening portion 65 of each hinge portion is directed toward a direction opposite to the direction C, the inadvertent disengagement of the gripper portion 62 from the cartridge frame 3*a* can be prevented.

Figure 10:
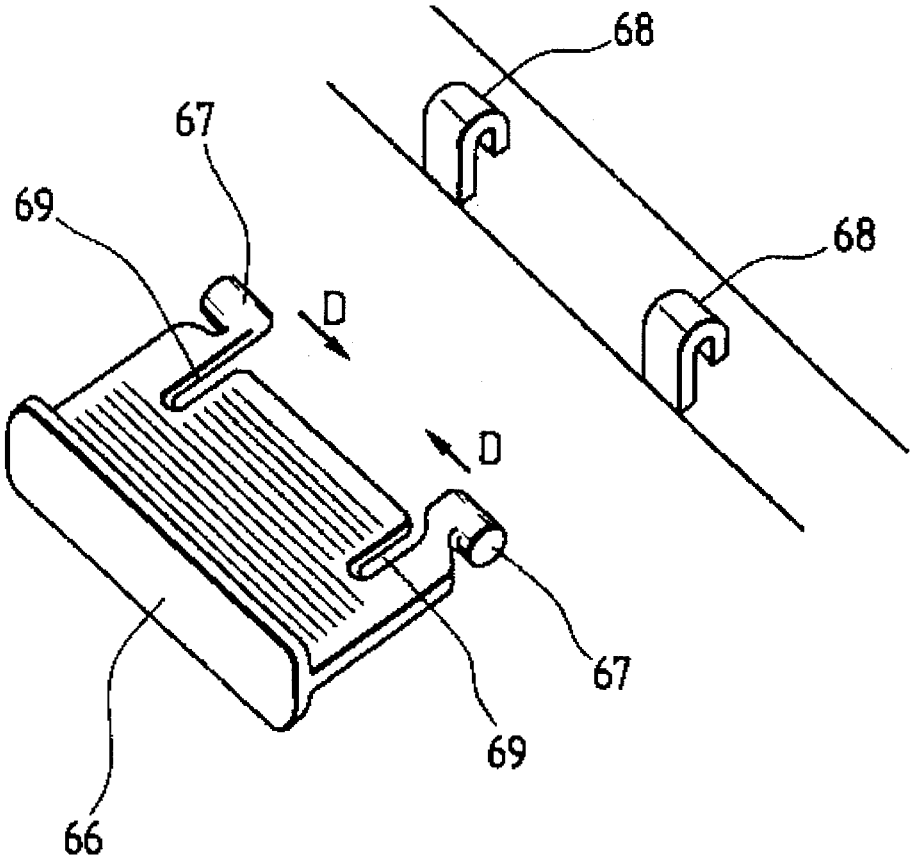
FIG. 10 is a perspective view showing a gripper portion according to another embodiment.
Figure 11:
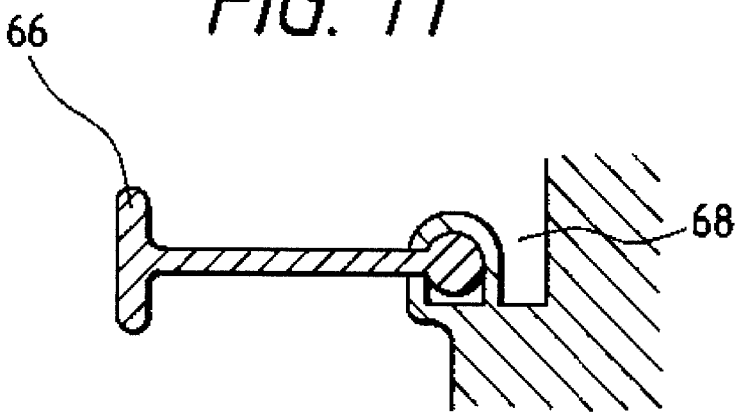
FIG. 11 is a side view of the gripper portion of FIG. 10.

Next, a gripper portion according to another embodiment will be explained with reference to FIGS. 10 and 11.

Shafts 67 as pivot shafts are integrally formed with a gripper portion 66. Further, since slits 69 are formed in the gripper portion, the shafts 67 can be deflected inwardly (directions shown by the arrows D) (within the elastic deformation range of resin material). When the gripper portion 66 is attached to hinge portions 68 of the cartridge frame 3*a*, the shafts 67 are fitted into the hinge portions 68 while elastically deforming the shafts in the directions D. After the fitting of the shafts into the hinge portions, since the shafts are returned to their original positions by elastic deformation, the gripper portion is not disengaged from the cartridge frame. In this embodiment, there are no slits 70 in the gripper portion as shown in FIG. 8, the improved stability can be obtained regarding the fitting of the shafts into the hinge portions.

In this way, since the gripper portions are formed independently from the process cartridge and the pivot shafts of the gripper portions are fitted into the hinge portions of the cartridge frame so that the gripper portions can be lightly pivoted around the pivot shafts, the following advantages can be obtained:

(1) Even a heavy cartridge can be supported;

(2) The assembling of the gripper portions can be simplified, and the packing workability is improved because of the light pivotal movement of the gripper portion and no restoring force of the gripper portions, and the risk of damaging the enclosing bag can be avoided; and (3) When the cartridge is inserted into the printer and the front door is closed, the drum shutter is rotated by the closing movement of the door, thereby easily pushing the gripper portions upwardly. Since the gripper portions can be pivoted with the light force, the drum shutter is not damaged.

Next, the positioning of the process cartridge when the cartridge is mounted to the printer will be fully explained.

As shown in FIG. 2, a protruded portion 71 constituting an engagement portion which can be engaged by a cartridge inserting guide portion 75 of the printer 1 with a projection/ recess relation, and a second surface 73 substantially in parallel with an end surface 72 (in the longitudinal direction of the cartridge) of the protruded portion 71 and adapted to engage by the guide portion 75 of the printer 1 are formed on at least one of both longitudinal ends of the cartridge 3. In this case, the second surface 73 is a front end surface of the rib 74 in the cartridge mounting direction.

The second surface 73 extends from a front end position (position a in FIG. 2) in the cartridge inserting direction C toward a rear end position, and the protruded portion 71 extends from an intermediate position (position b in FIG. 2) toward the rear end position.

Figure 12:
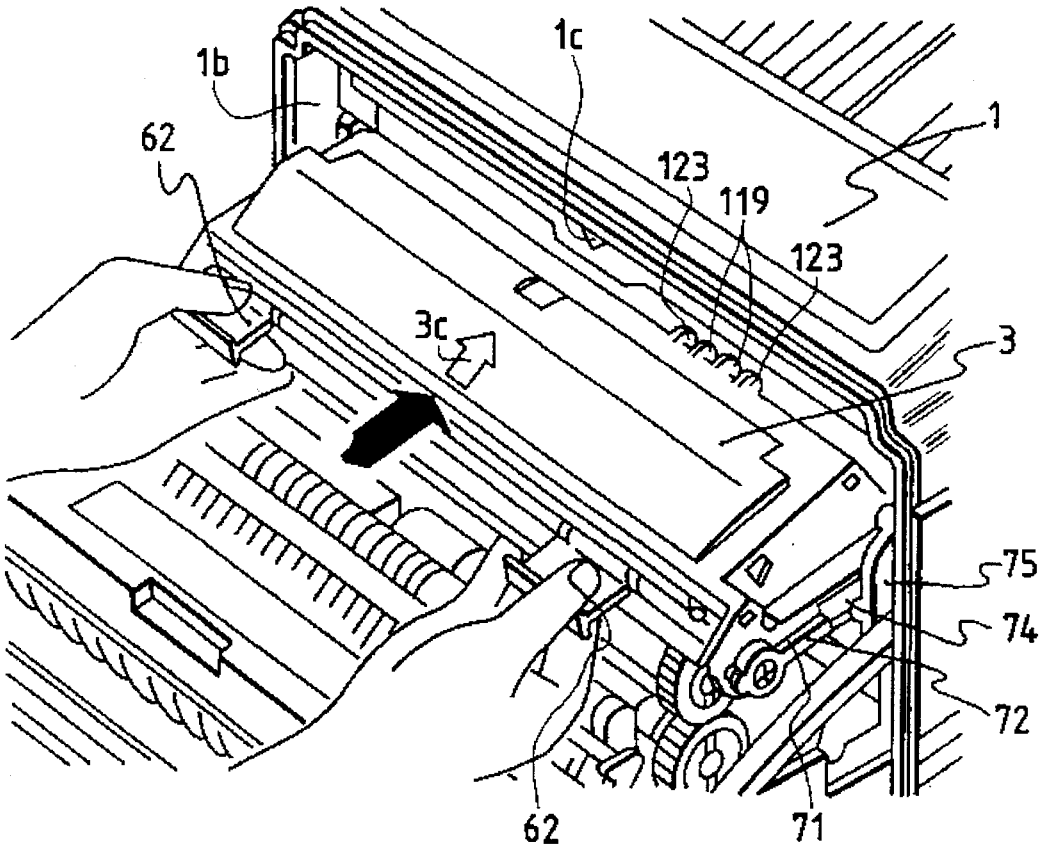
FIG. 12 is a perspective view showing a condition that the process cartridge is being mounted to the image forming apparatus.
Figure 13:
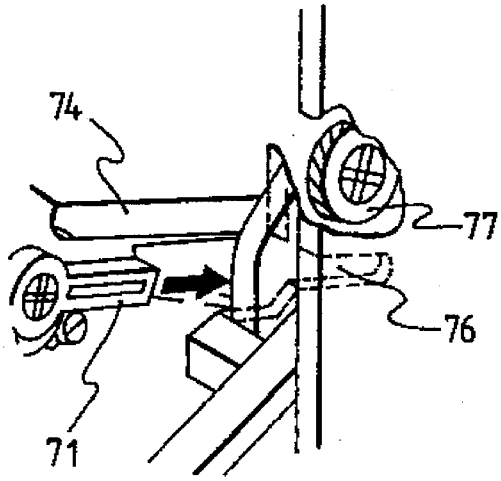
FIG. 13 is an enlarged perspective view showing guide portions of the process cartridge and the image forming apparatus.

With this arrangement, when the cartridge 3 is inserted into the printer as shown FIGS. 12 and 13, first of all, the second surface 73 is inserted along an inner surface of the cartridge inserting guide 75 of the printer 1 matching the configuration of the cartridge 3, thereby positioning the cartridge in the longitudinal direction. Then, when the protruded portion 71 is inserted along the guide 75, the inserting direction of the cartridge is determined.

That is, the rib 74 is protruded toward a direction perpendicular to the rotational direction of the photosensitive drum 4 more than the drum gear 78 and is disposed at the outside of the frame 3*a* (protruded from the frame 3*a* by about 15 mm). Further, the rib 74 continuously extends from the proximity of the flange 79 toward the side of the toner container 28. The rib 74 is so shaped that a front end surface 73 thereof in the cartridge mounting direction (near the toner container 28) has a substantially U-shaped arcuated configuration. Further, the protruded portion 71 as the mounted guide is protruded in the direction perpendicular to the rotational direction of the photosensitive drum 4 more than the rib 74 (protruded from the flange by about 5 mm). One end of the protruded portion 71 is contiguous to the flange 79, and the other end of the protruded portion reaches up to a substantially mid point of the cartridge 3 (i.e., the other end of the protruded portion 17 reaches the proximity of a grip 153).

When the process cartridge 3 is mounted to the printer 1, first of all, the rib 74 is guided along the guide 75 of the printer 1, thereby positioning the process cartridge 3 in the longitudinal direction. Then, the protruded portions 71, 79 as the mounting guides at both ends of the cartridge 3 are pushed along the guide holes 76, 97 of the printer 1, thereby determining the mounting direction of the cartridge 3.

Incidentally, in the illustrated embodiment, since the front end surface 73 (in the mounting direction) of the rib 74 has the continuous arcuated configuration, when the cartridge is mounted to the printer, if the rib is interfered with a movable part of the printer 1 (for example, a pivotable gear), the cartridge can smoothly be mounted since the rib can push such movable part aside.

In this way, according to the illustrated embodiment, since the positioning of the cartridge in the longitudinal direction and the determination of the mounting direction are not simultaneously effected at the position a in FIG. 2, but the positioning of the cartridge in the longitudinal direction is firstly effected and then the determination of the mounting direction is effected, the operability during the mounting of the cartridge can be improved.

Figure 9:
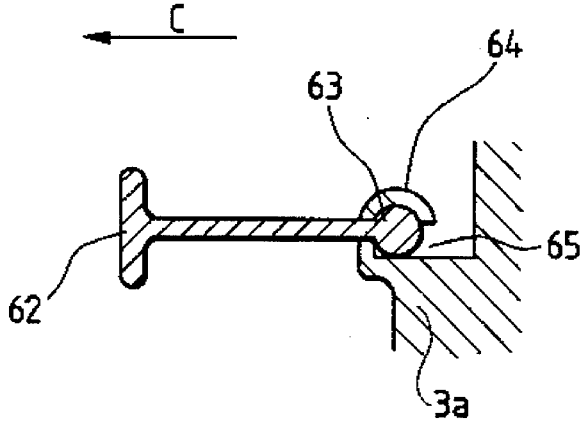
FIG. 9 is a side view of the gripper portion.
Figure 14:
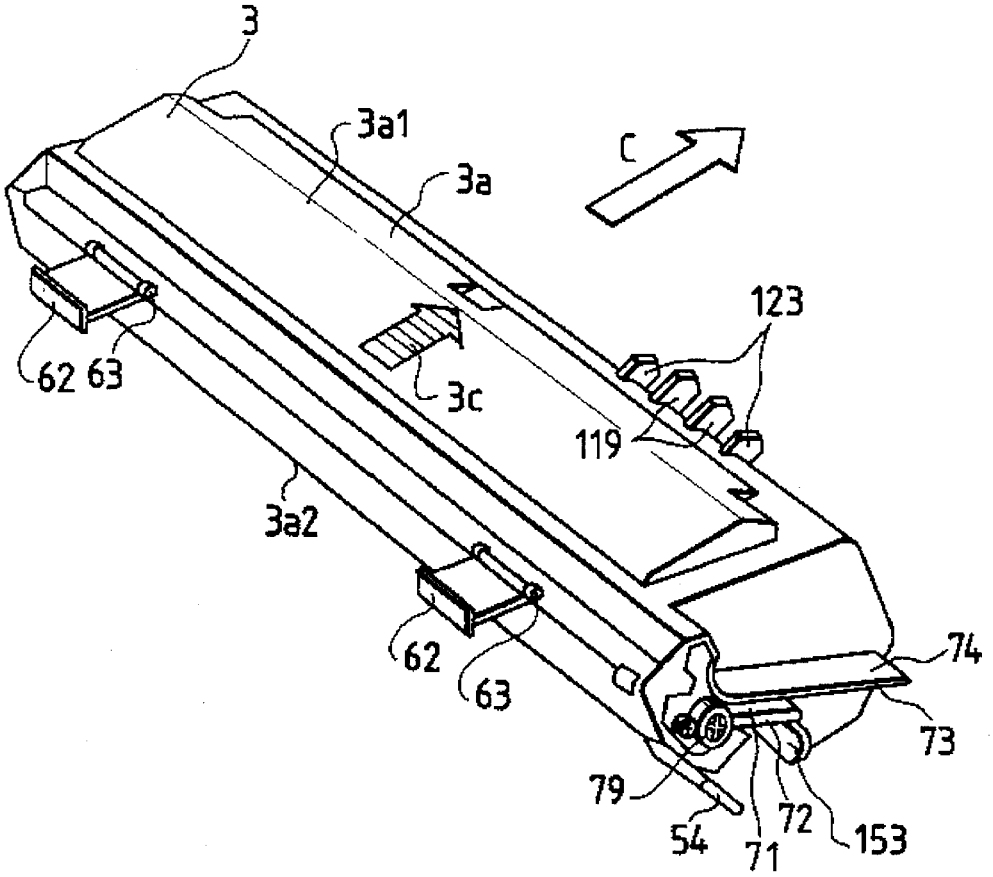
FIG. 14 is a perspective view of a process cartridge according to another embodiment of the present invention.

Incidentally, as shown in FIG. 9, when the protruded portion (guide rib) 71 is inserted into the hole of the guide 75 of the printer, the drum gear 78 (described later) of the cartridge is engaged by the drum drive gear 78 of the printer. Further, the rib 74 may have a flat plate-shaped configuration as shown in FIG. 14, so long as it has the second surface 73.

Figure 15:
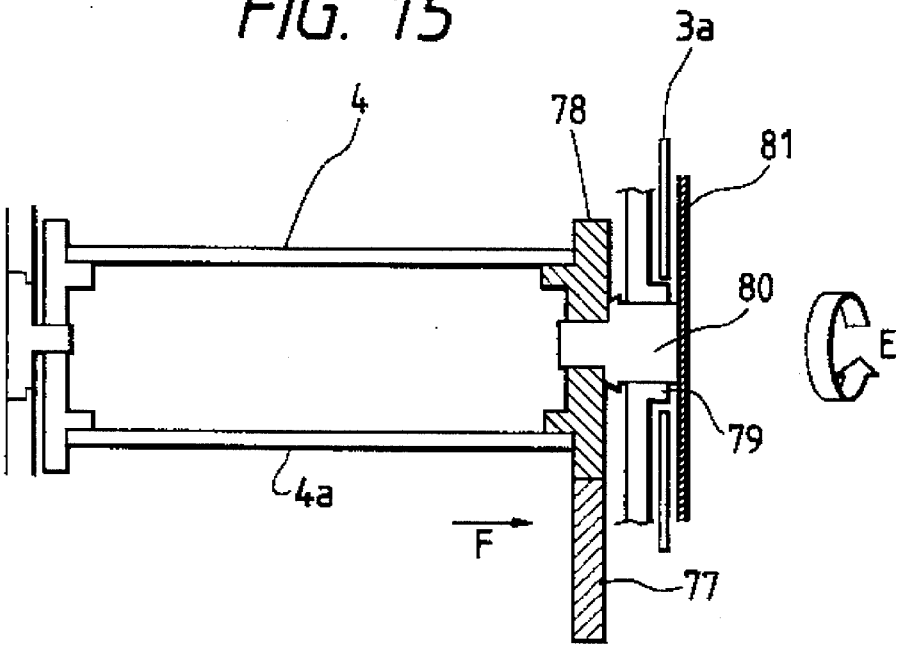
FIG. 15 is a sectional view showing a supporting portion for a photosensitive drum of the process cartridge.

Next, the positioning between the photosensitive drum 4 of the process cartridge 3 and the printer 1 will be explained with reference to FIG. 15.

When the drum gear 78 adhered and secured to the photosensitive drum 4 is rotatingly driven in a direction shown by the arrow E by the drum drive gear 77, since the drum gear 78 is a helical gear, a thrust force directing to a direction shown by the arrow F is generated. Thus, the flange portion 79 of the process cartridge 3 and the drum positioning pin 80 inserted in the drum gear 78 are shifted to the direction F together with the photosensitive drum 4. As a result, the surface of the drum positioning pin 80 is closely contacted with a positioning side plate 81 of the printer 1. Consequently, even when the photosensitive drum 4 is driven to lower the drum, there is no torsion between the drum 4 and the printer 1, thereby positioning the photosensitive drum 4 with respect to the printer 1 correctly. Thus, it is possible to improve the image quality.

Figure 16:
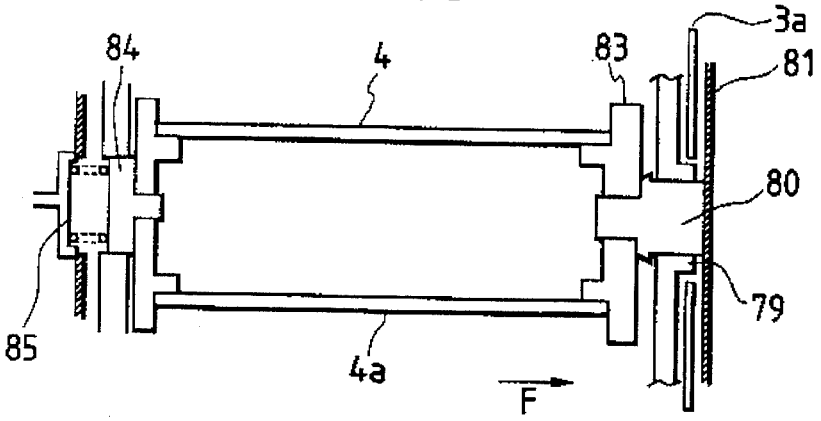
FIG. 16 is a sectional view showing a supporting portion for a photosensitive drum according to another embodiment.

Another embodiment using the similar principle is shown in FIG. 16.

As shown in FIG. 16, when a drum gear 83 adhered and secured to the photosensitive drum 4 is a spur gear, a thrust force is generated on a photosensitive drum positioning pin 84 arranged at the other longitudinal end of the photosensitive drum 4 by an elastic force of a spring member 85, thereby directly pushing the photosensitive drum 4 in a direction shown by the arrow F. As a result, it is possible to closely contact the surface of the drum positioning pin 80 with the positioning plate of the printer 1. Accordingly, the positioning between the printer 1 and the process cartridge 3 and therefore the positional relation between the printer 1 and the photosensitive drum 4 can be effected correctly.

Next, a further embodiment will be explained with reference to FIG. 17.

Figure 17:
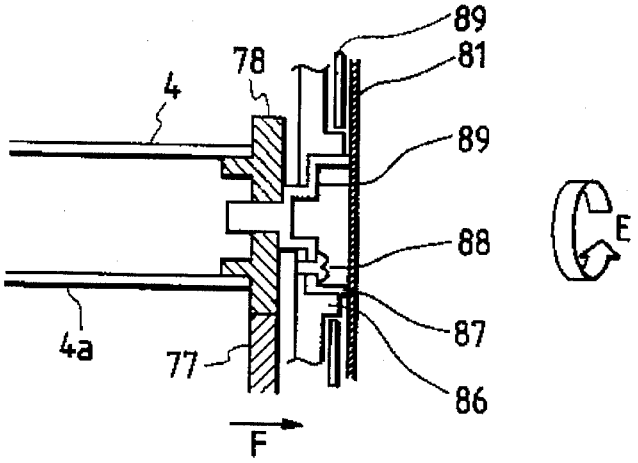
FIG. 17 is a sectional view showing a supporting portion for a photosensitive drum according to a further embodiment.
Figure 18:
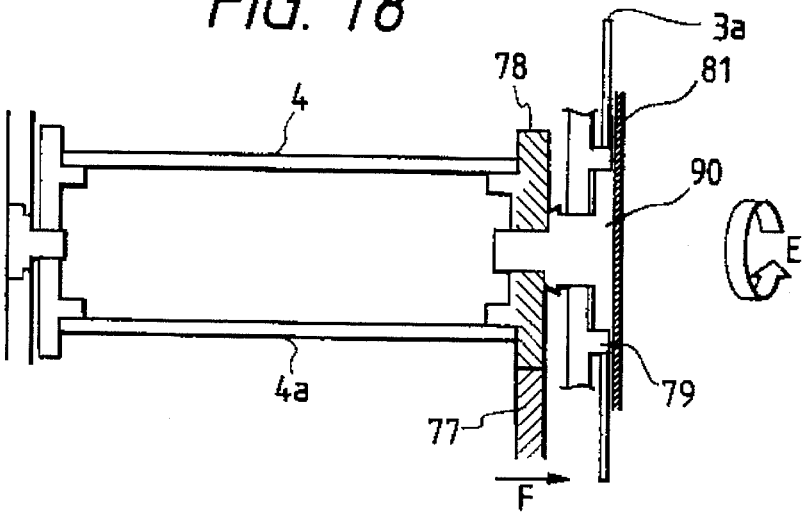
FIG. 18 is a sectional view showing a supporting portion for a photosensitive drum according to a still further embodiment.

In the embodiment shown in FIG. 17, a positioning pin 87 inserted in the drum gear 78 adhered and secured to the photosensitive drum 4 and a flange portion 86 of the frame 3*a* of the process cartridge 3 is connected to the flange portion 86 by a screw 85. In this embodiment, since the positioning pin and the flange portion are interconnected at one point, a portion of the positioning pin 87 is slightly floating from the flange 86 at an area shown by 89. Thus, when the photosensitive drum 4 is rotated to generate the thrust force, the surface of the positioning pin 87 can be closely contacted with the positioning plate 81 of the printer 1, thereby positioning the photosensitive drum 4 with respect to the printer 1 correctly. Further, because of the one point connection, the positioning pin is not disengaged from the flange during the transportation of the cartridge 3. Further, as shown in FIG. 18, when an area of a drum positioning pin 90 is increased as large as possible, as the driving force is applied to the photosensitive drum 4, the lowering of the photosensitive drum can effectively be prevented, thereby maintaining the positional relation between the photosensitive drum and the printer 1 more correctly.

Figure 19:
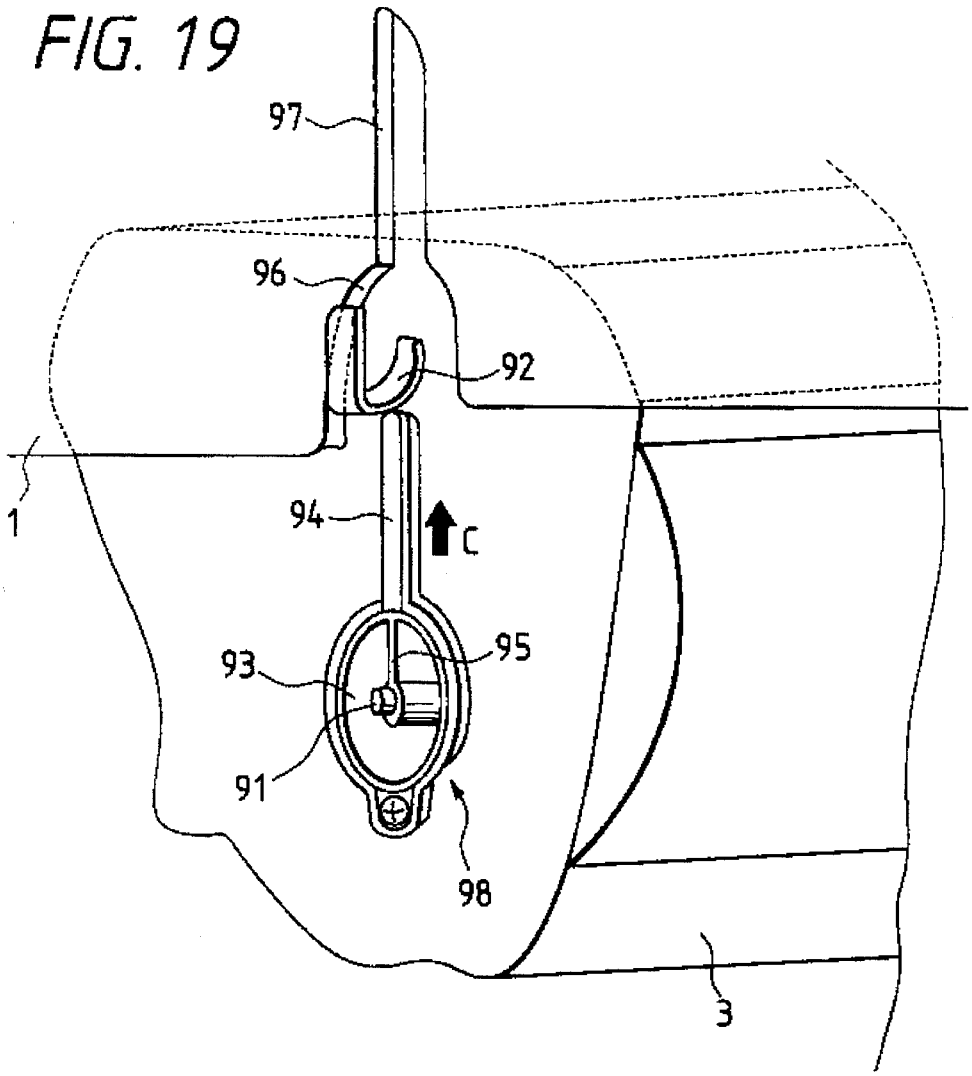
FIG. 19 is a perspective view showing a drum earth portions of the process cartridge and the image forming apparatus.

Next, a drum earth electrode 91 of the process cartridge 3 and a drum earth high voltage contact 92 of the image forming apparatus 1 and therearound will be fully explained with reference to FIG. 19.

A drum earth electrode (rotary shaft) 91 comprising a conductive parallel pin is inserted into a central hole of a drum positioning pin at a non-drive side of the process cartridge 3 (side opposite to a side where the drum gear 78 is arranged with respect to the longitudinal direction (thrust direction) of the photosensitive drum 4). The rotary shaft 91 is protruded from the longitudinal end of the cartridge. A recess (material removing area) 93 is formed around the rotary shaft in order to save the material and to reduce the cost. Within the recess 93, there is arranged a rib (protection member) 95 extending along a line connecting between a guide rib 94 (corresponding to the guide rib 71 provided on the other end of the process cartridge 3) for guiding the process cartridge when the cartridge is mounted to the image forming apparatus 1 and the drum earth electrode 91. The guide rib 94 is positioned at an end of the cartridge opposite to an end where the rib 71 (FIG. 2) is provided. Further, within the image forming apparatus 1, a drum earth high voltage contact 92 is attached to the proximity of a positioning member 96 for positioning a flange 151 (corresponding to the flange 79 provided at the other end of the process cartridge 3). The high voltage contact 92 is formed from conductive spring member so that it can be elastically abutted against the drum earth electrode 91.

Accordingly, when the guide rib 94 of the process cartridge 3 is inserted along the guide hole 97 of the image forming apparatus 1 in the direction shown by the arrow C, the drum earth high voltage contact 92 of the image forming apparatus 1 is firstly laid on the guide rib 94 of the process cartridge 3 and then is slid on the rib 95 of the drum positioning portion 98. When the positioning portion 98 is positioned with respect to the positioning portion 96 of the apparatus 1, i.e., when the process cartridge 3 is mounted to the mounting portion 113, the drum earth high voltage contact 92 is elastically contacted with the drum earth electrode 91 without fail. Therefore, the drum earth high voltage contact 92 of the image forming apparatus 1 can surely be contacted with the drum earth electrode 91 without being caught by the positioning recess of the process cartridge 3.

Figure 20:
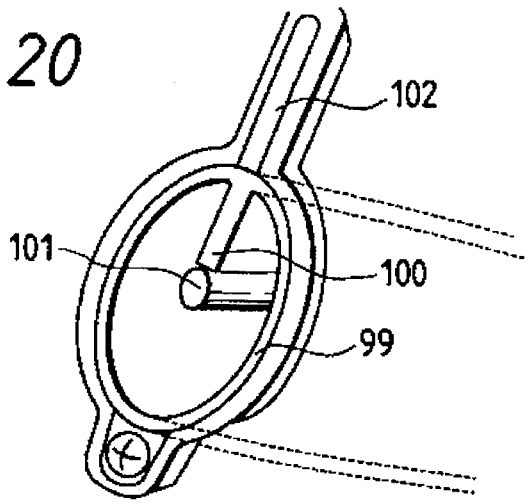
FIG. 20 is a perspective view of a drum earth portion of a process cartridge, according to another embodiment.

A still further embodiment will be explained with reference to FIG. 20. In the previous embodiment, while a step existed between the rib of the drum positioning pin and the drum earth electrode, in this embodiment, as shown in FIG. 20, a height of a rib 100 of a drum positioning pin 99 is equal to a height of a drum earth electrode 101 and a height of the rib 100 is also equal to a height of a guide rib 102 so that a smooth inclined surface is formed on the rib 100. Accordingly, when the process cartridge 3 is mounted to the image forming apparatus 1, the drum earth high voltage contact (not shown) of the apparatus 1 is slid on the guide rib of the process cartridge 3 and on the rib 100 of the drum positioning pin 99 without any step, thereby contacting with the drum earth electrode 101 more smoothly.

Next, a supporting method for the photosensitive drum 4 will be explained with reference to FIG. 21.

Figure 21:
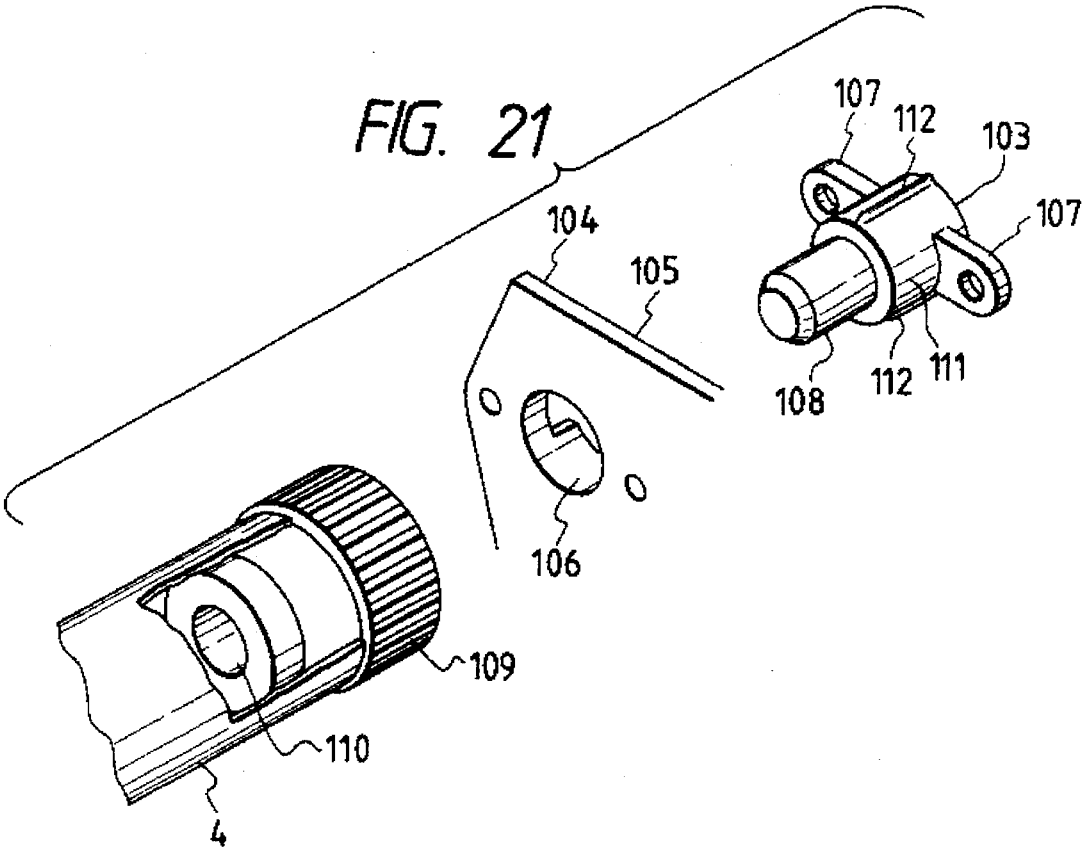
FIG. 21 is an exploded perspective view of a drum supporting portion of the process cartridge.

In FIG. 21, a drum support shaft 103 is fitted into a hole 106 formed in an arm portion 105 extending from a cleaner container 104. Flanges 107 of the drum support shaft is secured to the cleaner container by screws (not shown).

A boss portion 108 of the drum support shaft 103 is fitted into a central hole 110 of a gear flange 109 secured to the end of the photosensitive drum 4 by an adhesive, press-fit or caulking or the like, so that the photosensitive drum 4 can be slidingly rotated. Incidentally, the drum support shaft 103 is made of plastics having self-lubricant property such as polyacetal, so that the gear flange 109 can be rotated smoothly on the shaft. Further, the boss 108 of the drum support shaft 103 is fitted into the hole of the gear flange 109 with a clearance-fit.

On the other hand, three longitudinal ribs 112 are formed on a main diameter portion 111 of the drum support shaft 103, and a circumscribed circle passing apexes of the ribs is greater than the fitting hole 106 of the arm portion 105 of the cleaner container 104 into which the boss is inserted by about 0.1 to 0.3 mm. Accordingly, at three points where the ribs 112 are provided, the boss is press-fitted into the fitting hole 106 so that the drum support shaft 103 is press-fitted into the fitting hole 106. Further, the drum support shaft is secured by the screws (not shown). Incidentally, the cleaner container 104 is made of plastic material such as modified PPO, polycarbonate, polystyrene, ABS or the like so that, when the drum support shaft 103 is press-fitted into the hole 106, recesses are formed in the hole by the ribs 112. On the other hand, when the press-fitted, the ribs 112 of the drum support shaft 103 are also deformed. Accordingly, since the inner surface of the fitting hole 106 and the ribs 112 of the drum support shaft 103 are deformed each other so that they are subjected to reaction forces, they can be tightly secured to each other without any play. Incidentally, the frame 3*a* of the process cartridge 3 is made from the same material.

Figure 22:
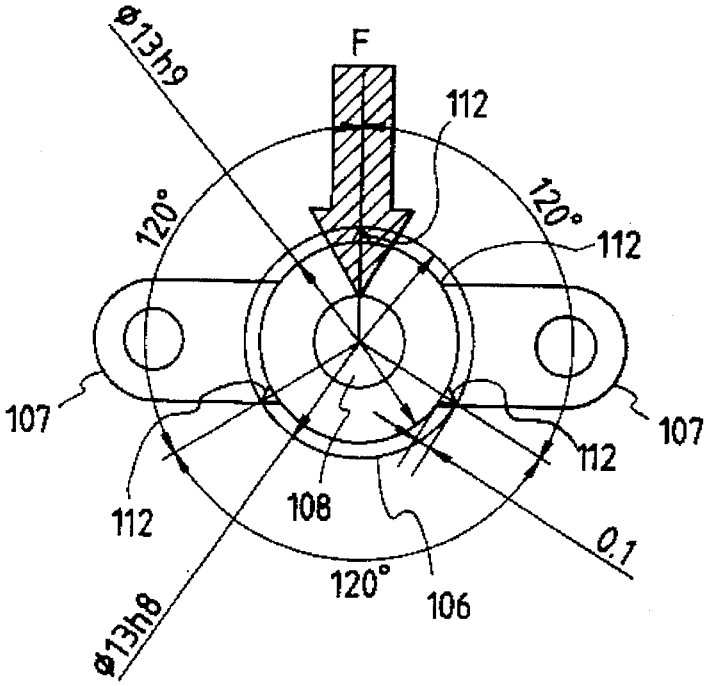
FIG. 22 is a view showing a force applied to the image forming apparatus to which the process cartridge is mounted, when the image forming apparatus is driven.

Next, the disposition of the ribs 112 on the main diameter portion of the drum support shaft 103 will be further fully explained with reference to FIGS. 22 and 23. FIG. 22 is a front view showing a 10 condition that the drum support shaft 103 is press-fitted into the cleaner container 1041, and FIG. 23 is a schematic view showing a direction of a force. The three ribs 112 on the main diameter portion 111 of the drum support shaft 103 are equidistantly (120 degrees) spaced apart from each other. Further, the photosensitive drum 4 is subjected to the meshing force between the drive gear 77 and the drum gear 78, urging force of the charger roller 5 and abutment force of the cleaning blade 15*a*. Among these forces, the forces other than the meshing force F between the drive gear 77 and the drum gear 78 are transmitted to the drum support shaft 103 via the gear flange. The meshing force F acts in a direction inclined from a common tangential line regarding pitch circles of drive gear 77 and the drum gear 78 toward the drum gear by a pressure angle. This force F is supported by two ribs 112 (among three) equally.

In this case, when a diameter of the main diameter portion 111 of the drum support shaft 103 is $\phi$ 13h9, a height of each rib is 0.1, and an inner diameter of the fitting hole 106 of the cleaner container 104 is $\phi$ 13H8, the optimum deformation amount of ribs 112 can be obtained.

If the meshing force F acts between the rib 112 and the rib 112, the force F will act on the other rib 112 wholly, with the result that the deformation amount of the other rib 112 will be greater than those of other two ribs, thereby deviating the center of the drum slightly. Accordingly, by arranging the ribs 112 on the main diameter portion 111 of the drum support shaft as mentioned above, it is possible to uniformly support the force acting on the drum support shaft 103, thereby preventing the center of the drum from deviating.

Incidentally, the sectional configuration of each rib 112 may be triangular, semi-circular or the combination thereof. Further, the number of ribs 112 may be more than four so long as they are positioned to support the force F. Further, the force for inserting the drum support shaft 103 into the fitting hole 106 may be sufficient to only deform the ribs 112, with the result that the operator can easily insert the drum support shaft into the fitting hole without using any tool. Incidentally, ribs 112 may be formed in the fitting hole 106. Also in this case, the same advantage can be obtained.

Figure 24:
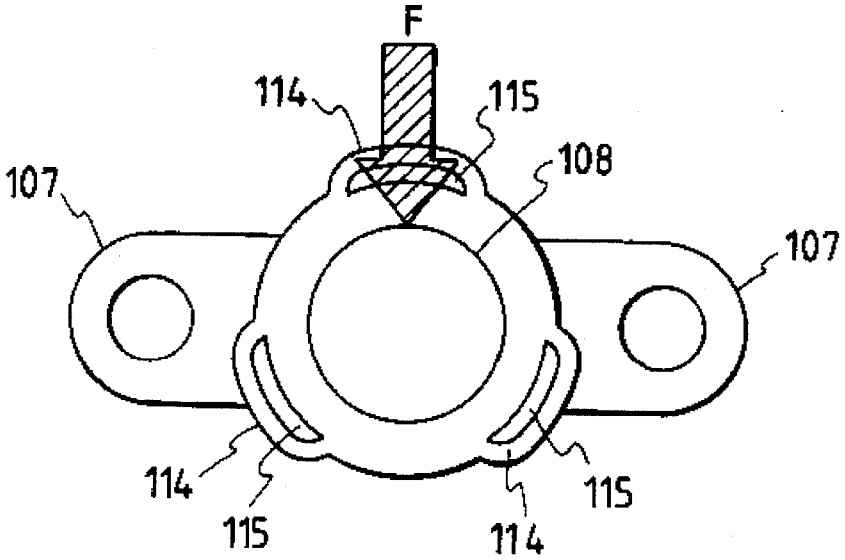
FIG. 24 is a view showing a drum supporting portion according to another embodiment.

FIG. 24 shows a drum support shaft according to another embodiment.

In this embodiment, a drum support shaft 113 is fitted into a fitting hole 106 formed in an arm portion 105 extending from a cleaner container 104. Flange portions 107 of the drum support shaft are secured to the cleaner container by screws (not shown). A boss portion 108 of the drum support shaft is engaged by a gear flange arranged at the end of the photosensitive drum 4 so that the photosensitive drum 4 is rotatably supported.

Three projections 114 are formed on a main diameter portion 111 of the drum support shaft 113, and a circumscribed circle passing apexes of the projections is slightly greater than a diameter of the fitting hole 106 of the cleaner container 104. Within each projection 114, cavity (material removing zone) 115 is formed, and, accordingly, a thickness of a wall of each projection 114 is thin. One of three projections 114 is positioned to a location where the force F acts on the projection, and this force F is supported by other two projections. Thus, when the drum support shaft 113 is inserted into the fitting hole 106 of the cleaner container 104, the projections 114 are deformed to compress the cavities 115.

The drum support shaft 113 is firmly secured in the fitting hole 106 without any play by the reaction force of the projections, thereby stabilizing the rotation of the photosensitive drum 4. Further, even when the gear flange 109 is subjected to the force F from the drive gear (not shown) of the image forming apparatus 1 in a direction of the pressure angle, the drum is not displaced. Further, also in this case, since the force for inserting the drum support shaft into the fitting hole is small, the assembling can be facilitated.

Figure 25:
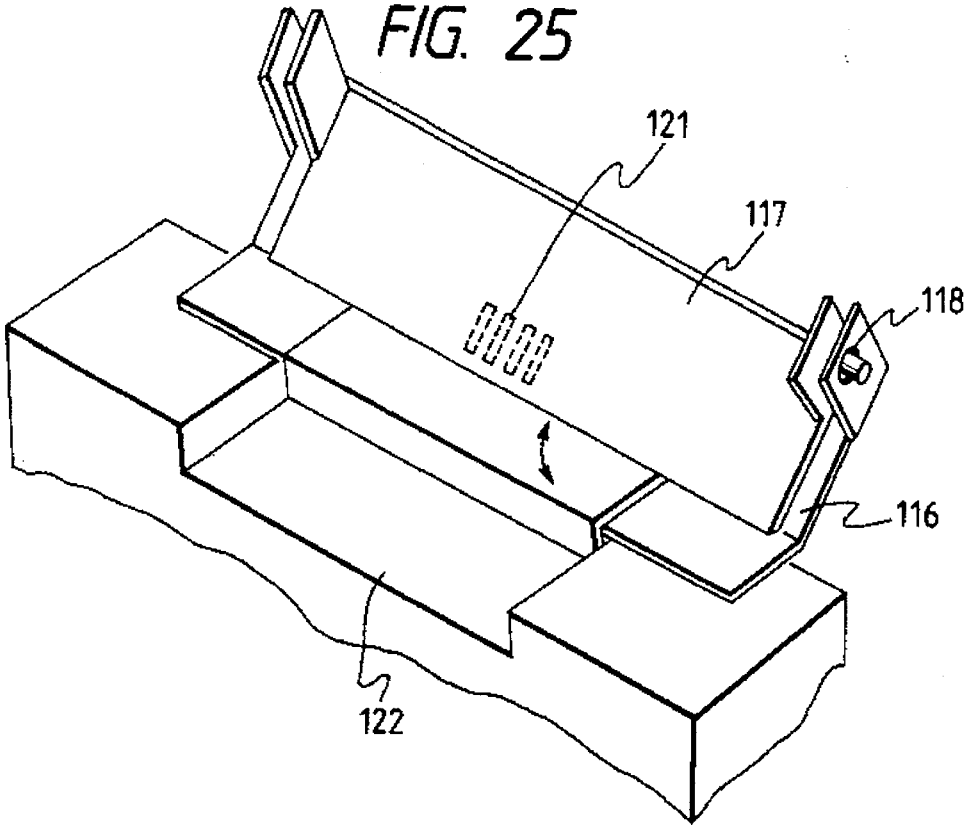
FIG. 25 is a perspective view of a laser shutter portion of the image forming apparatus.

Next, an opening/closing mechanism for the laser shutter will be explained with reference to FIG. 25.

Figure 26:
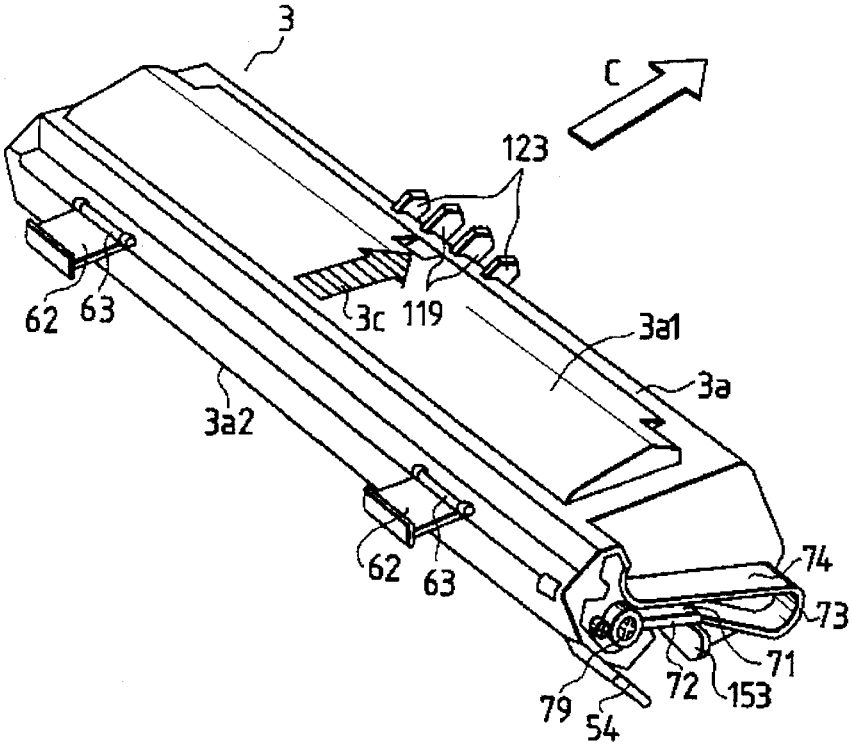
FIG. 26 is a perspective view of a process cartridge according to a further embodiment of the present invention.

As mentioned above, the laser shutter 117 is pivotally mounted on the inner cover 116 of the apparatus 1 for pivotal movement around a hole 118. When the process cartridge 3 is not mounted to the image forming apparatus 1, the laser shutter 117 acting as the laser light path blocking means is lowered by its own weight to close the laser light path (refer to FIG. 4). Accordingly, even if the laser light is emitted by the erroneous operation, since the laser light path is blocked, the laser light is prevented from leaking out of the apparatus 1. On the other hand, as shown in FIG. 26, laser shutter ribs (first projections) 119 for actuating the laser shutter 117 are protruded from the frame 3*a* of the process cartridge 3 at a central portion thereof in its longitudinal direction. When the process cartridge 3 is mounted to the image forming apparatus, the laser shutter ribs 119 are protruded through openings 121 formed in the inner cover 116 to abut against the laser shutter 117, thereby urging the laser shutter 117, with the result that the laser shutter 117 is pushed upwardly around the hole 118, thus opening a laser light opening 122 formed in the apparatus 1 (refer to FIG. 3). Incidentally, the laser shutter ribs 119 are offset from a longitudinal center l (FIG. 32) of the photosensitive drum 4 toward the drum gear 78 in the direction perpendicular to the rotational direction of the photosensitive drum 4.

Figure 27:
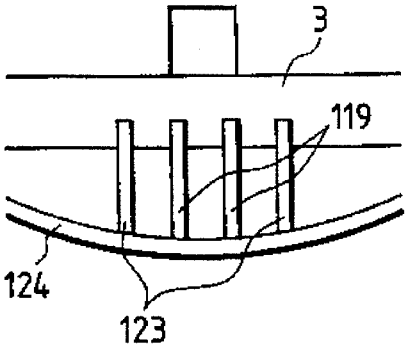
FIG. 27 is a view showing an engagement relation between laser shutter ribs of the process cartridge and an enclosing bag.

Second projections 123 each having a protruded amount smaller than that of the first projection 119 are arranged on both sides of the first projections and adjacent to the latter. Thus, in a condition that the process cartridge 3 is packed by a bag 124, even if the process cartridge is subjected to the inadvertent shock, as shown in FIG. 27, since tip ends of four projections are uniformly abutted against the inner surface of the bag 124, any force is prevented from concentrating at one point, thereby preventing the bag 124 from tearing during the transportation of the process cartridge 3.

In this way, it is possible to prevent the reduction of the tribo applying ability of the toner t in the process cartridge due to the wetting of the toner, thereby preventing the reduction of the image density and the fog of the image. Further, since the second projections 123 are arranged on both sides of the first projections 119, the first projections are protected by the second projections 123.

In order to open the laser shutter 117, concretely, the protruded amount of each laser shutter rib 119 (from the frame 3*a*) is more than 6 mm, and less than 18 mm since, if the protruded amount is too great, the strength of the rib 119 itself is decreased to easily damage it. Further, when the cartridge is mounted to the apparatus, the laser light path blocking means is abutted against the first projections, but is not abutted against the second projections.

Next, another embodiment regarding laser shutter ribs will be explained with reference to FIG. 2.

Figure 28:
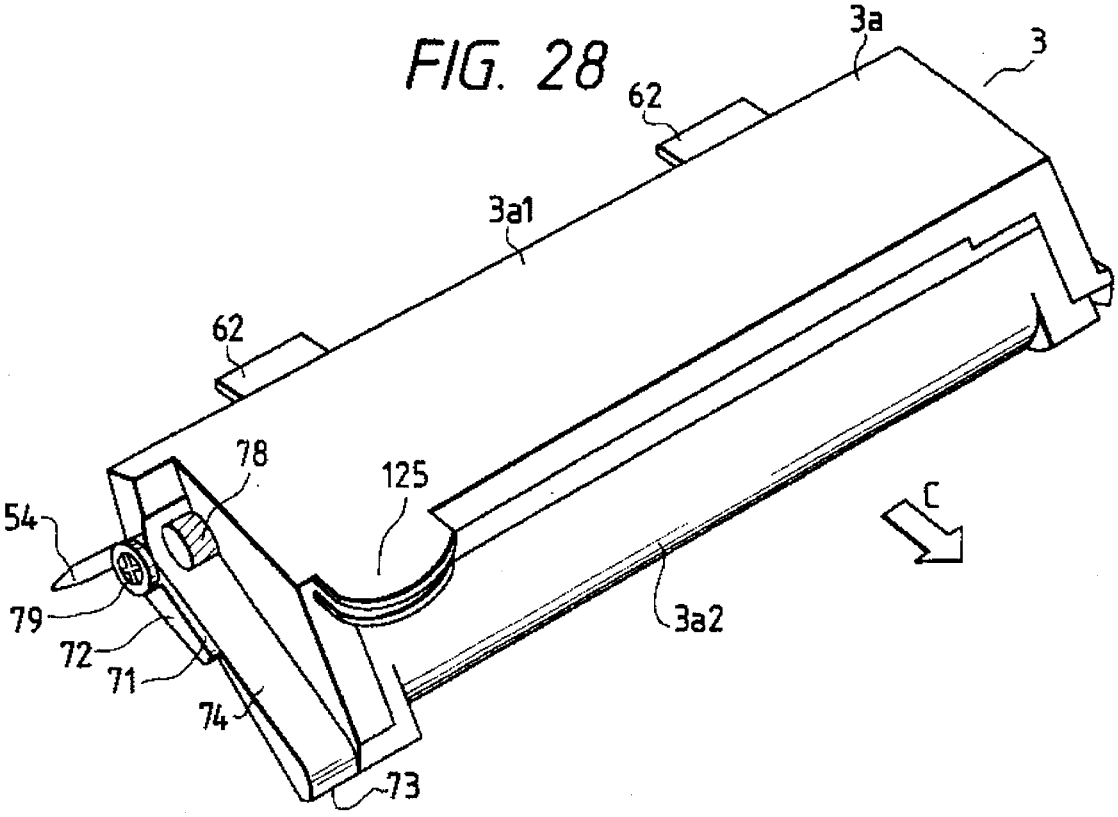
FIG. 28 is a perspective view of a process cartridge according to a still further embodiment of the present invention.
Figure 29:
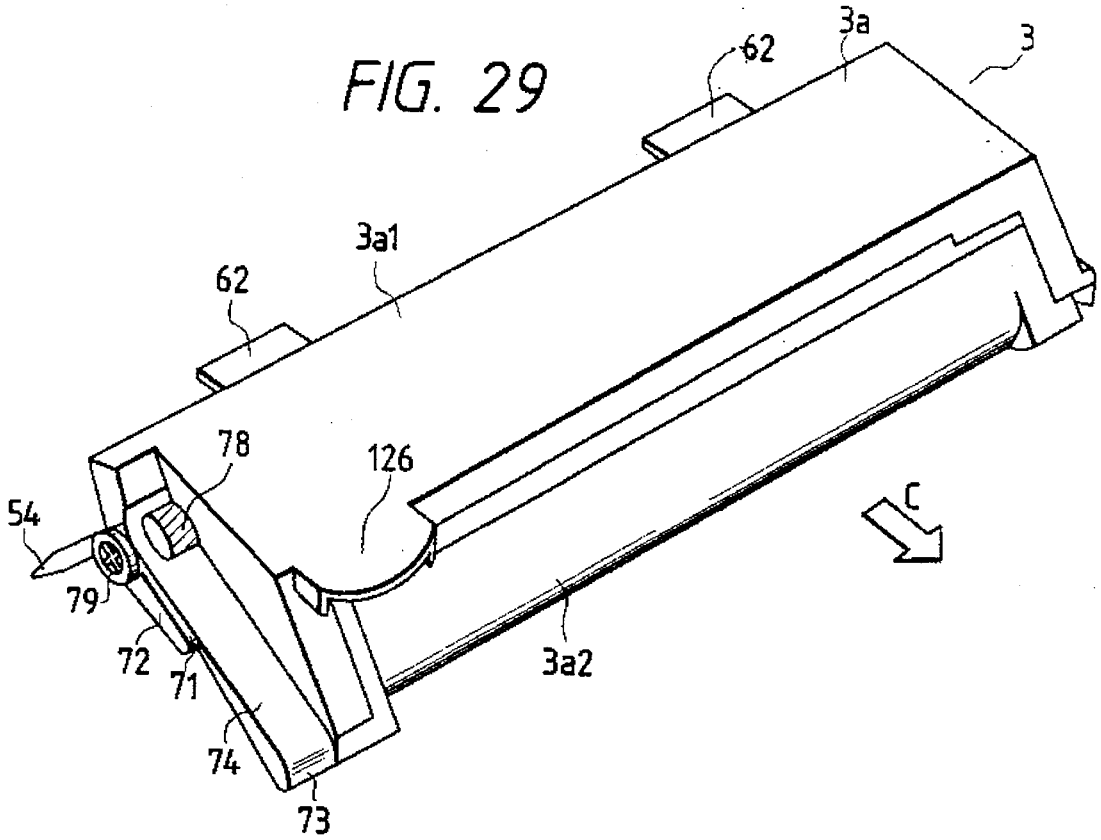
FIG. 29 is a perspective view of a process cartridge according to a further embodiment of the present invention.

In an embodiment shown in FIG. 2, laser shutter ribs (abutment portions) 119 for abutting against the laser light path blocking means to open the laser light path are protruded from the cartridge frame offset from a center of the photosensitive drum 4 (cartridge 3) in the longitudinal direction toward the drum gear (driving force receiving portion) 78. The drum gear 78 is arranged at the right (FIG. 2) end of the cartridge so that it can be meshed with the drive gear 77 of the apparatus 1 shown in FIG. 13 (FIGS. 28 and 29). Accordingly, when the driving force is transmitted from the drive gear 77 of the apparatus 1 to the drum gear 78, since the force F shown in FIG. 23 is generated, even if the cartridge 3 is not completely inserted into the predetermined position, the cartridge 3 is mounted to the predetermined position by the force F. Thus, it is not feared that the image formation is effected when the laser shutter is not opened completely.

Further, even when the laser shutter 117 is heavy, since the process cartridge 3 can be shifted to the predetermined position in the apparatus 1 by the meshing force F without being overcome by the weight of the laser shutter 117, it is possible to open the laser shutter without fail. Incidentally, it should be noted that openings through which the laser shutter ribs 119 are protruded are formed in the inner cover of the apparatus 1.

Next, a further embodiment regarding laser shutter ribs will be explained with reference to FIG. 28.

In this embodiment, as shown in FIG. 28, longitudinal ribs 125 are formed on the frame 3*a* of the cartridge at one longitudinal end thereof.

Two ribs 125 are arranged side by side in a vertical direction, and each rib 125 has a sector-shaped tip end. Thus, since the whole tip end surface of the rib is abutted against the bag 124, it is possible to prevent the bag 124 from tearing. Furthermore, since the ribs 125 extends in the longitudinal direction of the process cartridge 3, the frame 3*a* of the cartridge is reinforced by the ribs 125.

Next, a still further embodiment regarding a laser shutter rib will be explained with reference to FIG. 29. In the embodiment shown in FIG. 29, a laser shutter rib 126 has a laid U-shaped configuration.

With this arrangement, as in the aforementioned embodiments, it is possible to prevent the bag from tearing. Further, since the laser shutter rib 126 has the laid U-shaped configuration, when the laser shutter rib is abutted against the laser shutter, the laser shutter rib can be prevented from deforming by the weight of the laser shutter.

Next, a further embodiment regarding a laser shutter rib will be explained with reference to FIG. 30.

Figure 30:
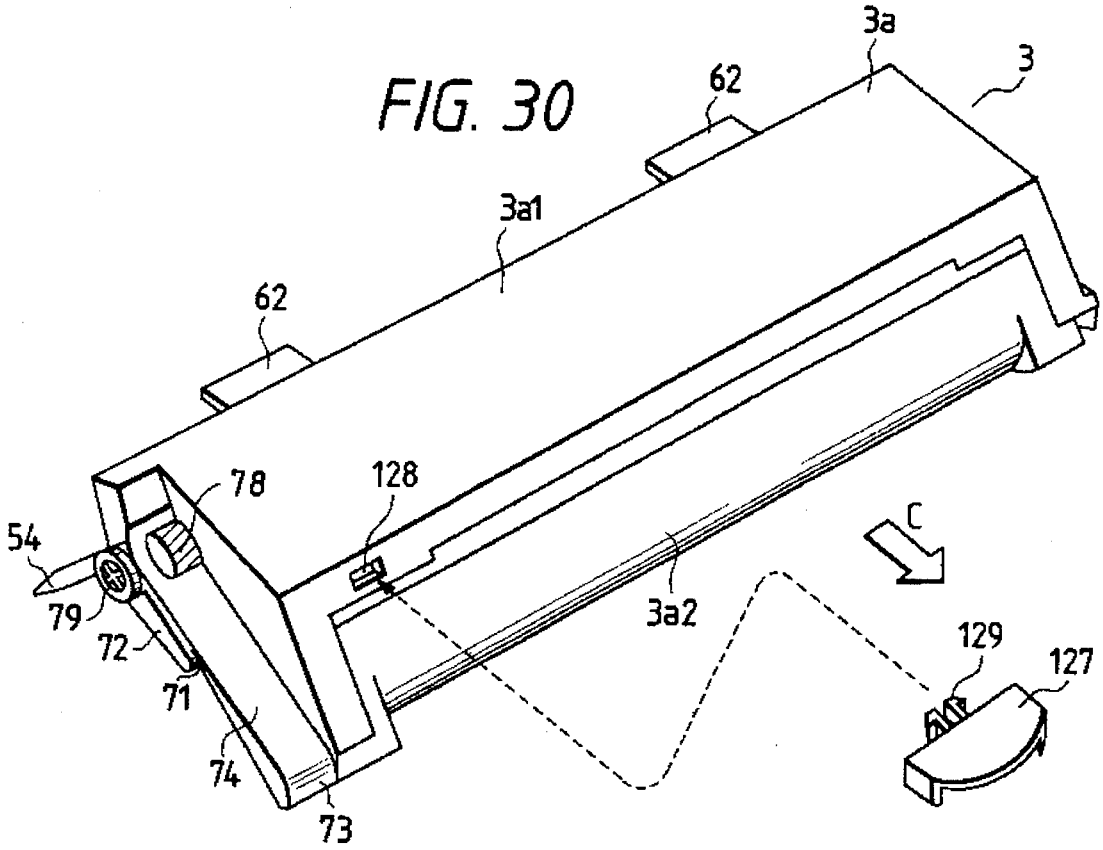
FIG. 30 is a perspective view of a process cartridge according to a still further embodiment of the present invention.

In the embodiment shown in FIG. 30, a laser shutter rib 127 is formed independently from the frame 3*a* of the cartridge. A hole 128 is formed in the cartridge frame 3*a* and a snap-fit 129 is formed on the laser shutter rib 127. By fitting the snap-fit 129 into the hole 128, the laser shutter rib 127 can be removably attached to the cartridge frame 3*a*. With this arrangement, the following advantage can be obtained.

In general, a plurality of process cartridges having same appearances but including different kind of toners such as smaller particle toner having a particle diameter of 5 to 6 μm, regular toner having a particle diameter of about 15 μm or the like are prepared. These process cartridges are used properly in accordance with the specification (for example, most fine image, high speed print and the like) of the image forming apparatus. In this respect, according to the above embodiment, since the laser shutter rib 127 is removable with respect to the frame of the cartridge, by changing the height or configuration of the rib, process cartridges can be discriminated.

Figure 32:
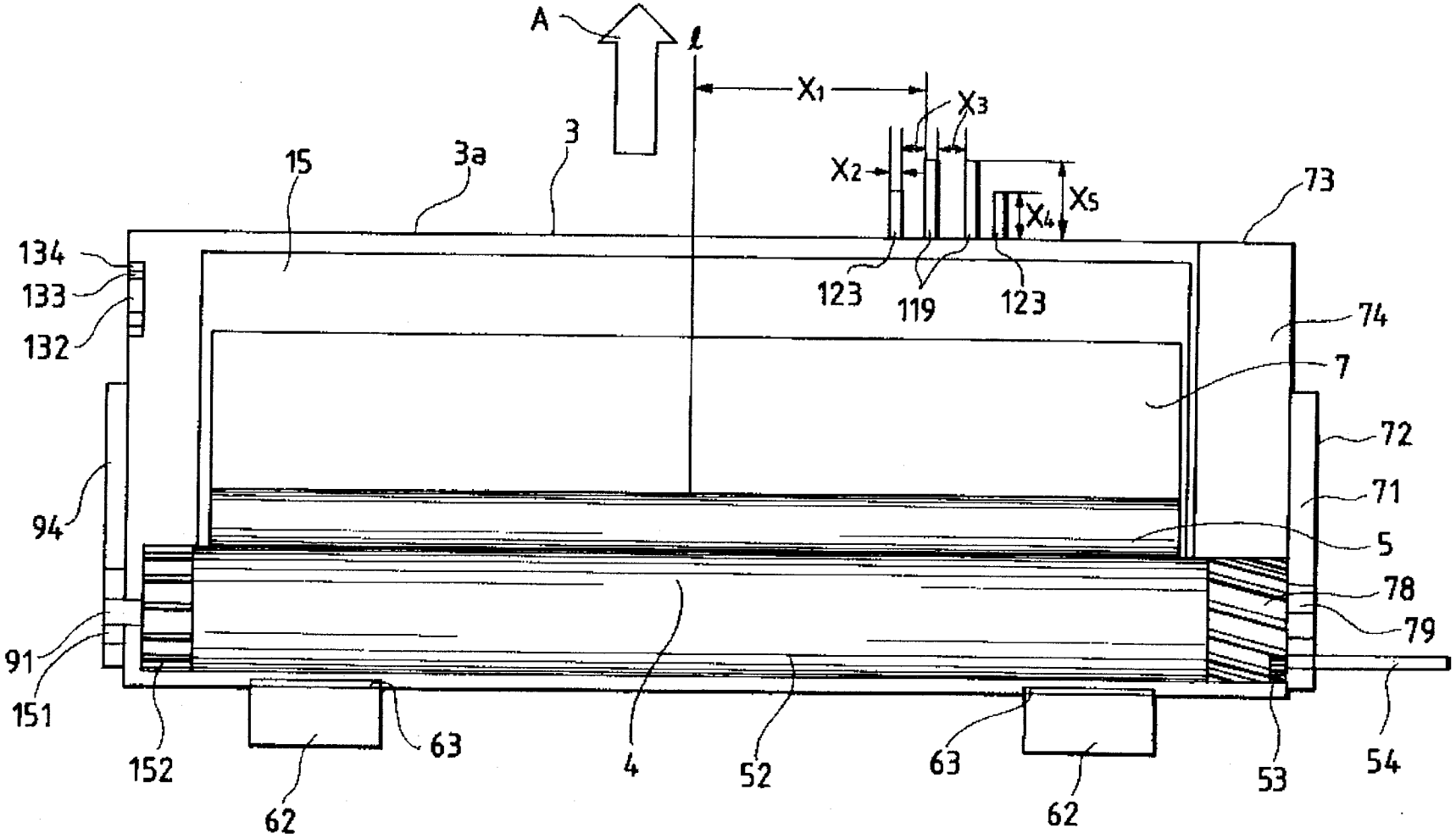
FIG. 32 is a schematic plan view of the process cartridge of FIG. 2.
Figure 33:
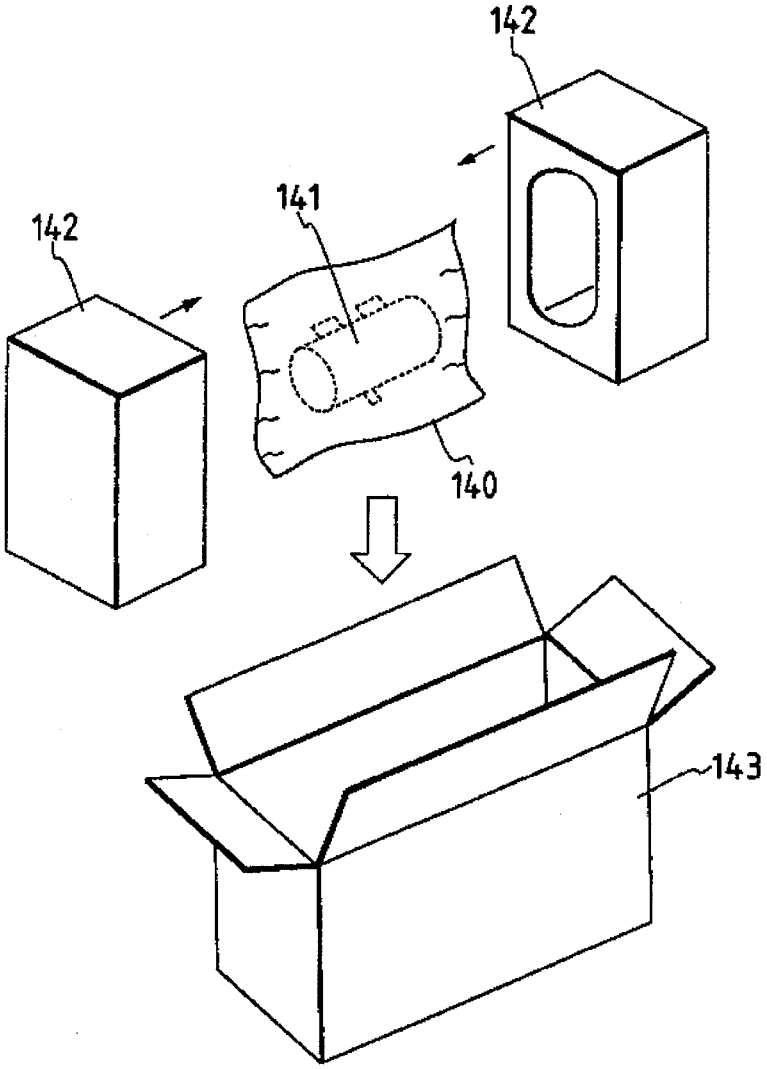
FIG. 33 PRIOR ART
FIG. 33 is a perspective view showing a condition that a conventional process cartridge is being packaged.
Figure 34:
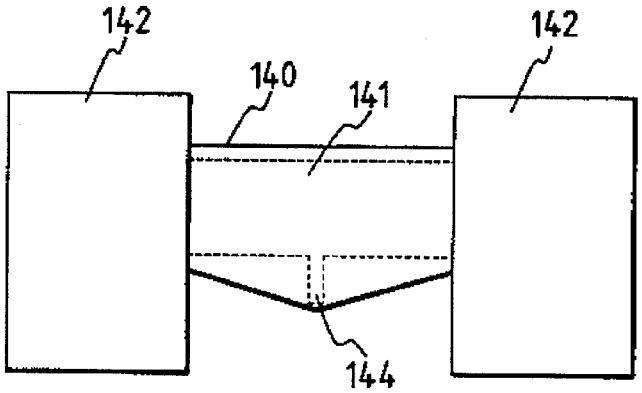
FIG. 34 PRIOR ART
FIG. 34 is a perspective view showing a condition that the conventional process cartridge is packed.

By the way, FIG. 32 is a schematic plan view of the process cartridge 3 shown in FIG. 2.

As mentioned above, the process cartridge 3 shown in FIG. 32 has the drum shutter spring 53, drum shutter pin 54, rib 74 and laser shutter ribs 119 at the same side as a side where the drum gear 78 is provided (i.e., offset from the center l of the photosensitive drum 4 toward the drum gear 78) with respect to the longitudinal direction of the photosensitive drum 4 (longitudinal direction of the process cartridge 3). That is, in the cartridge 3 according to this embodiment, since the aforementioned elements are gathered at the cartridge side where the drum gear 78 is arrange, it is possible to attach these elements to the frame 3*a* of the cartridge with high accuracy. The reason is that these elements can be attached to the frame by using the same cartridge end as the common reference. As a result, it is possible to surely mount the process cartridge 3 to the predetermined position 113 of the image forming apparatus 1, to surely open the laser shutter 117 and to surely open the drum shutter 52. Further, the drum gear 78 is arranged at the cartridge end where the process cartridge 3 is subjected to the mounting load when the process cartridge 3 is mounted to the image forming apparatus 1 (mounting direction is shown by the arrow A). Accordingly, when the drum gear 78 is engaged by the drive gear 77 of the apparatus 1, the shock is relieved, thereby permitting the smooth engagement between the drum gear and the drive gear. The reason is that the side of the process cartridge 3 where the laser shutter ribs 119 are arranged is subjected to the greater load for opening the laser shutter 117.

Furthermore, according to this embodiment, the aforementioned three contacts 132, 133, 134 are arranged at the cartridge end opposite to the cartridge end where the drum gear 78 for receiving the driving force from the image forming apparatus 1. Thus, it is possible to achieve the electrical connection substantially without the influence of the vibration due to the transmission of the driving force.

Incidentally, the drum gear 78 is also meshed with a gear (not shown) of the developing roller 11 so that the developing roller 11 is rotated by the driving force from the apparatus 1. Further, the reference numeral 152 denotes a spur gear secured to the end of the photosensitive drum 4. The transfer roller 8 of the apparatus 1 is rotated by the driving force from the apparatus 1 via the spur gear 152.

Now, sizes of the photosensitive drum 4, drum gear 78 and laser shutter ribs 119,123 according to this embodiment will be described. Incidentally, while the following sizes are optimum values for the image formation of maximum so-called A3 size, the present invention is not limited to these values.

(i) Photosensitive drum 4 sleeve diameter: about 20 mm, sleeve length: about 326 to 330 mm, coating length of photosensitive layer (organic photosensitive body): about 336 to 340 mm.

(ii) Drum gear 78 number of teeth: 27, diameter (passing tip end): about 32 mm, width: about 9 to 10 mm, helix angle (right helix): about 22 degrees.

(iii) Laser shutter ribs 119, 123 a distance ($X_1$) between the longitudinal center l of photosensitive drum and side face of rib 119: about 80 mm (about 75 to 85 mm), width of rib 119, 123 ($X_2$): about 1.5 mm (about 1.0 to 1.5 mm), distance ($X_3$) between ribs 119 and 123 and between ribs 119: about 12.5 mm (about 11.5 to 13.5 mm), protruded length ($X_4$) of ribs 123 from frame 3*a*: about 8.5 mm (about 8.0 to 11.0 mm), protruded length ($X_5$) of ribs 119 from frame 3*a*: about 10.5 mm (about 10 to 13.0 mm).

As mentioned above, according to this embodiment, since the abutment portions of the cartridge for abutting against the laser light path blocking means are arranged on the cartridge frame offset from the longitudinal center of the photosensitive drum toward the driving force receiving means, even when the cartridge is not completely mounted to the image forming apparatus, it is possible to open the laser light path surely.

Further, since there are provided the second projections having the protruded amount smaller than those of the abutment portions, it is possible to prevent the enclosing bag from tearing and to protect the abutment portions.

Incidentally, the process cartridge may integrally incorporate therein an electrophotographic photosensitive body as an image bearing member, and a charger means, a developing means or a cleaning means as the process means, as a unit which can be removably mounted to an image forming apparatus, or may integrally incorporate therein an electrophotographic photosensitive body as an image bearing member, and at least one of a charger means, a developing means and a cleaning means as the process means, as a unit which can be removably mounted to an image forming apparatus, or may integrally incorporate therein an electrophotographic photosensitive body as an image bearing member, and at least a developing means as the process means, as a unit which can be removably mounted to an image forming apparatus.

As mentioned above, according to the present invention, the process cartridge can be positioned within the image forming apparatus with high accuracy. Further, when the process cartridge is mounted to the image forming apparatus, the shock generated due to the contact between the driving force receiving means of the process cartridge and the driving force transmitting means of the image forming apparatus is relieved, thereby smoothly contacting these means with each other.

What is claimed is:

1. A process cartridge removably mountable onto an electrophotographic image forming apparatus, said process cartridge comprising:

an electrophotographic photosensitive member;

process means for acting on said electrophotographic photosensitive member;

a driving force receiving member provided at one end portion of said electrophotographic photosensitive member in a direction perpendicular to a moving direction thereof;

a protection member shiftable between a protection position to protect said electrophotographic photosensitive member and a retract position where said protection member is retracted from the protection position;

a first projection member provided on a side portion of a toner containing portion and protruded in the direction perpendicular to the moving direction of said electrophotographic photosensitive member more than said driving force receiving member;

a guide member protruded in the direction perpendicular to the moving direction of said electrophotographic photosensitive member more than said first projection member;

a second projection member protruded in the moving direction of said electrophotographic photosensitive member and arranged offset from a center of said electrophotographic photosensitive member in the direction perpendicular to the moving direction thereof toward said one end portion where said driving force receiving member is provided, said second projection member comprising four spaced vertical plates, two of outer end vertical plates having protruded lengths smaller than those of two inner vertical plates for opening a laser shutter provided in a main body of the image forming apparatus upon mounting of said process cartridge onto the main body of the image forming apparatus; and a third projection member protruded from said protection member in the direction perpendicular to the moving direction of said electrophotographic photosensitive member and arranged at said one end portion where said driving force receiving member is provided in the direction perpendicular to the moving direction of said electrophotographic photosensitive member, said third projection member engaging with a member provided in the main body of the image forming apparatus upon mounting of said process cartridge onto the main body of the image forming apparatus, to shift said protection member to the retract position.

2. A process cartridge according to claim 1, wherein the protruded length of said outer end vertical plates is about 8.0 to 11.0 mm.

3. A process cartridge according to claim 1, wherein the protruded length of said inner vertical plates is about 10.0 to 13.0 mm.

4. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

driving force receiving means provided at one end portion of said electrophotographic photosensitive drum in a direction perpendicular to a moving direction thereof, wherein said driving force receiving means has a helical gear, and wherein the number of teeth of said helical gear is 27;

a protection member shiftable between a protection position to protect said electrophotographic photosensitive drum and a retract position where said protection member is retracted from the protection position;

first protection means provided on a side portion of a toner containing portion and protruded in the direction perpendicular to the moving direction of said electrophotographic photosensitive drum more than said driving force receiving means:

a guide member protruded in the direction perpendicular to the moving direction of said electrophotographic photosensitive drum more than said first projection means;

second projection means protruded in the moving direction of said electrophotographic photosensitive drum and arranged offset from a center of said electrophotographic photosensitive drum in the direction perpendicular to the moving direction thereof toward said one end portion where said driving force receiving means is provided; and third projection means protruded from said protection member in the direction perpendicular to the moving direction of said electrophotographic photosensitive drum and arranged at said one end portion where said driving force receiving means is provided in the direction perpendicular to the moving direction of said electrophotographic photosensitive drum.

5. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

driving force receiving means provided at one end portion of said electrophotographic photosensitive drum in a direction perpendicular to a moving direction thereof, wherein said driving force receiving means has a helical gear, and wherein said helical gear has a right helix;

a protection member shiftable between a protection position to protect said electrophotographic photosensitive drum and a retract position where said protection member is retracted from the protection position;

first projection means provided on a side portion of a toner containing portion and protruded in the direction perpendicular to the moving direction of said electrophotographic photosensitive drum more than said driving force receiving means;

a guide member protruded in the direction perpendicular to the moving direction of said electrophotographic photosensitive drum more than said first projection means;

second projection means protruded in the moving direction of said electrophotographic photosensitive drum and arranged offset from a center of said electrophotographic photosensitive drum in the direction perpendicular to the moving direction thereof toward said one end portion where said driving force receiving means is provided; and third projection means protruded from said protection member in the direction perpendicular to the moving direction of said electrophotographic photosensitive drum and arranged at said one end portion where said driving force receiving means is provided in the direction perpendicular to the moving direction of said electrophotographic photosensitive drum.

6. A process cartridge removably mountable onto an electrophotographic image forming apparatus, said process cartridge comprising:

an electrophotographic photosensitive member;

process means for acting on said electrophotographic photosensitive member;

a driving force receiving member provided at one end portion of said electrophotographic photosensitive member in a direction perpendicular to a moving direction thereof;

a protection member shiftable between a protection position to protect said electrophotographic photosensitive member and a retract position where it is retracted from the protection position;

a first projection member provided on a side portion of a toner containing portion and protruded in the direction perpendicular to the moving direction of said electrophotographic photosensitive member more than said driving force receiving member, wherein said first projection member has a substantially U-shaped configuration having a substantially semi-circular front end in a mounting direction of said process cartridge to the image forming apparatus;

a guide member protruded in the direction perpendicular to the moving direction of said electrophotographic photosensitive member more than said first projection member;

a second projection member protruded in the moving direction of said electrophotographic photosensitive member and arranged offset from a center of said electrophotographic photosensitive member in the direction perpendicular to the moving direction thereof toward said one end portion where said driving force receiving member is provided; and a third projection member protruded from said protection member in the direction perpendicular to the moving direction of said electrophotographic photosensitive member and arranged at said one end portion where said driving force receiving member is provided in the direction perpendicular to the moving direction of said electrophotographic photosensitive member, said third projection member engaging with a member provided in the main body of the image forming apparatus upon mounting of said process cartridge onto the main body of the image forming apparatus, to shift said protection member to the retract position.

7. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

a driving force receiving member provided at one end portion of said electrophotographic photosensitive drum in a direction perpendicular to a moving direction thereof;

a protection member shiftable between a protection position to protect said electrophotographic photosensitive drum and a retract position where said protection member is retracted from the protection position;

a first projection member provided on a side portion of a toner containing portion and protruded in the direction perpendicular to the moving direction of said electrophotographic photosensitive drum more than said driving force receiving member, wherein said first projection member is provided on an outer side of said process cartridge and extends from a proximity of said driving force receiving member to a side portion of said toner containing portion, and has a substantially U-shaped configuration having a substantially semi-circular front end in a mounting direction of said process cartridge to the image forming apparatus;

a guide member protruded in the direction perpendicular to the moving direction of said electrophotographic photosensitive drum more than said first projection member;

a second projection member protruded in the moving direction of said electrophotographic photosensitive drum and arranged offset from a center of said electrophotographic photosensitive drum in the direction perpendicular to the moving direction thereof toward said one end portion where said driving force receiving member is provided, said second projection member opening a laser shutter provided in a main body of the image forming apparatus upon mounting of said process cartridge onto the main body of the image forming apparatus; and a third projection member protruded from said protection member in the direction perpendicular to the moving direction of said electrophotographic photosensitive drum and arranged at said one end portion where said driving force receiving member is provided in the direction perpendicular to the moving direction of said electrophotographic photosensitive drum, said third projection member engaging with a member provided in the main body of the image forming apparatus upon mounting said process cartridge onto the main body of the image forming apparatus to shift said protection member to the retract position.

8. A process cartridge removably mountable onto an electrophotographic image forming apparatus, said process cartridge comprising:

an electrophotographic photosensitive member;

process means for acting on said electrophotographic photosensitive member;

a driving force receiving member provided at one end portion of said electrophotographic photosensitive member in a direction perpendicular to a moving direction thereof;

a protection member shiftable between a protection position to protect said electrophotographic photosensitive member and a retract position where said protection member is retracted from the protection position;

a first projection member provided on a frame and protruded from the frame in the moving direction of said electrophotographic photosensitive member and arranged offset toward said one end portion where said driving force receiving member is provided in the direction perpendicular to the moving direction of said electrophotographic photosensitive member; and a second projection member provided on said protection member and protruded from said protection member in the direction perpendicular to the moving direction of said electrophotographic photosensitive member and arranged at said one end portion where said driving force receiving member is provided in the direction perpendicular to the moving direction of said electrophotographic photosensitive member, wherein a third projection member extending from the proximity of said driving force receiving member to a side portion of a toner containing portion and having a substantially U-shaped configuration having a substantially semi-circular front end in a mounting direction of said process cartridge to the image forming apparatus is provided on an outer side of said process cartridge.

9. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

driving force receiving means provided at one end portion of said electrophotographic photosensitive drum in a direction perpendicular to a moving direction thereof and having a helical gear, wherein a number of teeth of said helical gear is 27;

a protection member shiftable between a protection position to protect said electrophotographic photosensitive drum and a retract position where said protection member is retracted from the protection position;

projection means provided on a frame and protruded from the frame in the moving direction of said electrophotographic photosensitive drum and arranged offset toward said one end portion where said driving force receiving means is provided in the direction perpendicular to the moving direction of said electrophotographic photosensitive drum; and projection means provided on said protection member and protruded from said protection member in the direction perpendicular to the moving direction of said electrophotographic photosensitive drum and arranged at said one end portion where said driving force receiving means is provided in the direction perpendicular to the moving direction of said electrophotographic photosensitive drum.

10. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

driving force receiving means provided at one end portion of said electrophotographic photosensitive drum in a direction perpendicular to a moving direction thereof and having a helical gear, wherein said helical gear has a right helix;

a protection member shiftable between a protection position to protect said electrophotographic photosensitive drum and a retract position where said protection member is retracted from the protection position;

projection means provided on a frame and protruded from the frame in the moving direction of said electrophotographic photosensitive drum and arranged offset toward said one end portion where said driving force receiving means is provided in the direction perpendicular to the moving direction of said electrophotographic photosensitive drum; and projection means provided on said protection member and protruded from said protection member in the direction perpendicular to the moving direction of said electrophotographic photosensitive drum and arranged at said one end portion where said driving force receiving means is provided in the direction perpendicular to the moving direction of said electrophotographic photosensitive drum.

11. A process cartridge according to claim 1, further comprising a conductive member arranged at the other end portion opposite said one end portion of said electrophotographic photosensitive member where a gear as said driving force receiving member is provided in the direction perpendicular to the moving direction of said electrophotographic photosensitive member.

12. A process cartridge according to claim 11, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

13. A process cartridge according to claim 1, wherein said process cartridge integrally incorporates therein charger means, developing means, or cleaning means as said process means, as a unit which can be removably mounted to the image forming apparatus.

14. A process cartridge according to claim 1, wherein said process cartridge integrally incorporates therein at least one of charger means, developing means, and cleaning means as said process means, as a unit which can be removably mounted to the image forming apparatus.

15. A process cartridge according to claim 1, wherein said process cartridge integrally incorporates therein at least developing means as said process means, as a unit which can be removably mounted to the image forming apparatus.

16. A process cartridge according to claim 6, further comprising a conductive member arranged at the other end portion opposite said one end portion of said electrophotographic photosensitive member where a gear as said driving force receiving member is provided in the direction perpendicular to the moving direction of said electrophotographic photosensitive member.

17. A process cartridge according to claim 16, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

18. A process cartridge according to claim 6, wherein said process cartridge integrally incorporates therein charger means, developing means, or cleaning means as said process means, as a unit which can be removably mounted to the image forming apparatus.

19. A process cartridge according to claim 6, wherein said process cartridge integrally incorporates therein at least one of charger means, developing means, and cleaning means as said process means, as a unit which can be removably mounted to the image forming apparatus.

20. A process cartridge according to claim 6, wherein said process cartridge integrally incorporates therein at least developing means as said process means, as a unit which can be removably mounted to the image forming apparatus.

21. A process cartridge according to claim 7, further comprising a conductive member arranged at the other end portion opposite said one end portion of said electrophotographic photosensitive drum where a gear as said driving force receiving member is provided in the direction perpendicular to the moving direction of said electrophotographic photosensitive drum.

22. A process cartridge according to claim 21, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

23. A process cartridge according to claim 8, further comprising a conductive member arranged at the other end portion opposite said one end portion of said electrophotographic photosensitive member where a gear as said driving force receiving member is provided in the direction perpendicular to the moving direction of said electrophotographic photosensitive member.

24. A process cartridge according to claim 23, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

25. A process cartridge according to claim 8, wherein said process cartridge integrally incorporates therein charger means, developing means, or cleaning means as said process means, as a unit which can be removably mounted to the image forming apparatus.

26. A process cartridge according to claim 8, wherein said process cartridge integrally incorporates therein at least one of charger means, developing means, and cleaning means as said process means, as a unit which can be removably mounted to the image forming apparatus.

27. A process cartridge according to claim 8, wherein said process cartridge integrally incorporates therein at least developing means as said process means, as a unit which can be removably mounted to the image forming apparatus.

28. An image forming apparatus to which a process cartridge can be removably mounted onto a main body of said image forming apparatus and which is adapted to form an image on a recording medium, said image forming apparatus comprising:

(a) mounting means capable of mounting a process cartridge including an electrophotographic photosensitive member; process means for acting on the electrophotographic photosensitive member; a driving force receiving member provided at one end portion of the electrophotographic photosensitive member in a direction perpendicular to a moving direction thereof; a protection member shiftable between a protection position to protect the electrophotographic photosensitive member and a retract position where the protection member is retracted from the protection position; a first projection member provided on a side portion of a toner containing portion and protruded in the direction perpendicular to the moving direction of the electrophotographic photosensitive member more than the driving force receiving member; a guide member protruded in the direction perpendicular to the moving direction of the electrophotographic photosensitive member more than the first projection member; a second projection member protruded in the moving direction of the electrophotographic photosensitive member and arranged offset from a center of the electrophotographic photosensitive member in the direction perpendicular to the moving direction thereof toward the one end portion where the driving force receiving member is provided, the second projection member comprising four spaced vertical plates, two of outer end vertical plates having protruded lengths smaller than those of two inner vertical plates for opening a laser shutter provided in a main body of said image forming apparatus upon mounting of the process cartridge onto said main body of said image forming apparatus; and a third projection member protruded from the protection member in the direction perpendicular to the moving direction of the electrophotographic photosensitive member and arranged at the one end portion where the driving force receiving member is provided in the direction perpendicular to the moving direction of the electrophotographic photosensitive member, the third projection member engaging with a member provided in said main body of said image forming apparatus upon mounting of the process cartridge onto said main body of said image forming apparatus, to shift the protection member to the retract position;

(b) driving force transmitting means for transmitting a driving force to the driving force receiving member;

(c) guide means for guiding the guide member;

(d) regulating means for regulating the first projection member;

(e) a laser shutter adapted to abut against the second projection member; and (f) an abutment member adapted to abut against the third projection member to open the protection member.

29. An image forming apparatus according to claim 28, wherein the protruded length of the end vertical plate is about 8.0 to 11.0 mm.

30. An image forming apparatus according to claim 28, wherein the protruded length of the inner vertical plate is about 10.0 to 13.0 mm.

31. An image forming apparatus according to claim 28, further comprising a conductive member arranged at the other end portion opposite the one end portion of the electrophotographic photosensitive member where a gear as the driving force receiving member is provided in the direction perpendicular to the moving direction of the electrophotographic photosensitive member.

32. An image forming apparatus according to claim 31, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

33. An image forming apparatus according to claim 28, wherein the process cartridge integrally incorporates therein charger means, developing means, or cleaning means as the process means, as a unit which can be removably mounted to said image forming apparatus.

34. An image forming apparatus according to claim 28, wherein the process cartridge integrally incorporates therein at least one of charger means, developing means, and cleaning means as the process means, as a unit which can be removably mounted to said image forming apparatus.

35. An image forming apparatus according to claim 28, wherein the process cartridge integrally incorporates therein at least developing means as the process means, as a unit which can be removably mounted to said image forming apparatus.

36. An image forming apparatus to which a process cartridge can be removably mounted onto a main body of said image forming apparatus and which is adapted to form an image on a recording medium, said image forming apparatus comprising:

(a) mounting means capable of mounting a process cartridge including an electrophotographic photosensitive member; process means for acting on the electrophotographic photosensitive member; a driving force receiving member provided at one end portion of the electrophotographic photosensitive member in a direction perpendicular to a moving direction thereof; a protection member shiftable between a protection position to protect the electrophotographic photosensitive member and a retract position where it is retracted from the protection position; a first projection member provided on a side portion of a toner containing portion and protruded in the direction perpendicular to the moving direction of the electrophotographic photosensitive member more than the driving force receiving member, wherein the first projection member has a substantially U-shaped configuration having a substantially semi-circular front end in a mounting direction of the process cartridge to said image forming apparatus; a guide member protruded in the direction perpendicular to the moving direction of the electrophotographic photosensitive member more than the first projection member; a second projection member protruded in the moving direction of the electrophotographic photosensitive member and arranged offset from a center of the electrophotographic photosensitive member in the direction perpendicular to the moving direction thereof toward the one end portion where the driving force receiving member is provided; and a third projection member protruded from the protection member in the direction perpendicular to the moving direction of the electrophotographic photosensitive member and arranged at the one end portion where the driving force receiving member is provided in the direction perpendicular to the moving direction of the electrophotographic photosensitive member, the third projection member engaging with a member provided in said main body of said image forming apparatus upon mounting of the process cartridge onto said main body of said image forming apparatus, to shift the protection member to the retract position;

(b) driving force transmitting means for transmitting a driving force to the driving force receiving member;

(c) guide means for guiding the guide member;

(d) regulating means for regulating the first projection member;

(e) a laser shutter adapted to abut against the second projection member; and (f) an abutment member adapted to abut against the third projection member to open the protection member.

37. An image forming apparatus according to claim 36, further comprising a conductive member arranged at the other end portion opposite the one end portion of the electrophotographic photosensitive member where a gear as the driving force receiving member is provided in the direction perpendicular to the moving direction of the electrophotographic photosensitive member.

38. An image forming apparatus according to claim 36, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

39. An image forming apparatus according to claim 36, wherein the process cartridge integrally incorporates therein charger means, developing means, or cleaning means as the process means, as a unit which can be removably mounted to said image forming apparatus.

40. An image forming apparatus according to claim 36, wherein the process cartridge integrally incorporates therein an at least one of charger means, developing means, and cleaning means as the process means, as an unit which can be removably mounted to said image forming apparatus.

41. An image forming apparatus according to claim 36, wherein the process cartridge integrally incorporates therein at least developing means as the process means, as an unit which can be removably mounted to said image forming apparatus.

42. An image forming apparatus to which a process cartridge can be removably mounted onto a main body of said image forming apparatus and which is adapted to form an image on a recording medium, said image forming apparatus comprising:

(a) mounting means capable of mounting a process cartridge including an electrophotographic photosensitive drum; a charging roller for charging the electrophotographic photosensitive drum; a developing roller for developing a latent image formed on the electrophotographic photosensitive drum; a cleaning blade for removing toner remaining on the electrophotographic photosensitive drum; a driving force receiving member provided at one end portion of the electrophotographic photosensitive drum in a direction perpendicular to a moving direction thereof; a protection member shiftable between a protection position to protect the electrophotographic photosensitive drum and a retract position where the protection member is retracted from the protection position; a first projection member provided on a side portion of a toner containing portion and protruded in the direction perpendicular to the moving direction of the electrophotographic photosensitive drum more than the driving force receiving member, wherein the first projection member is provided on an outer side of the process cartridge and extends from a proximity of the driving force receiving member to a side portion of the toner containing portion, and has a substantially U-shaped configuration having a substantially semi-circular front end in a mounting direction of the process cartridge to said image forming apparatus; a guide member protruded in the direction perpendicular to the moving direction of the electrophotographic photosensitive drum more than the first projection member; a second projection member protruded in the moving direction of the electrophotographic photosensitive drum and arranged offset from a center of the electrophotographic photosensitive drum in the direction perpendicular to the moving direction thereof toward the one end portion where the driving force receiving member is provided, the second projection member opening a laser shutter provided in a main body of said image forming apparatus upon mounting of the process cartridge onto said main body of said image forming apparatus; and a third projection member protruded from the protection member in the direction perpendicular to the moving direction of the electrophotographic photosensitive drum and arranged at the one end portion where the driving force receiving member is provided in the direction perpendicular to the moving direction of the electrophotographic photosensitive drum, the third projection member engaging with a member provided in said main body of said image forming apparatus upon mounting the process cartridge onto said main body of said image forming apparatus to shift the protection member to the retract position;

(b) driving force transmitting means for transmitting a driving force to the driving force receiving member;

(c) guide means for guiding the guide member;

(d) regulating means for regulating the first projection member;

(e) a laser shutter adapted to abut against the second projection member; and (f) an abutment member adapted to abut against the third projection member to open the protection member.

43. A process cartridge according to claim 42, further comprising a conductive member arranged at the other end portion opposite the one end portion of the electrophotographic photosensitive drum where a gear as the driving force receiving member is provided in the direction perpendicular to the moving direction of the electrophotographic photosensitive drum.

44. An image forming apparatus according to claim 43, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

45. An image forming apparatus to which a process cartridge can be removably mounted onto a main body of said image forming apparatus and which is adapted to form an image on a recording medium, said image forming apparatus comprising:

(a) mounting means capable of mounting a process cartridge including an electrophotographic photosensitive member; process means for acting on the electrophotographic photosensitive member; a driving force receiving member provided at one end portion of the electrophotographic photosensitive member in a direction perpendicular to a moving direction thereof; a protection member shiftable between a protection position to protect the electrophotographic photosensitive member and a retract position where the protection member is retracted from the protection position; a first projection member provided on a frame and protruded from the frame in the moving direction of the electrophotographic photosensitive member and arranged offset toward the one end portion where the driving force receiving member is provided in the direction perpendicular to the moving direction of the electrophotographic photosensitive member; and a second projection member provided on the protection member and protruded from the protection member in the direction perpendicular to the moving direction of the electrophotographic photosensitive member and arranged at the one end portion where the driving force receiving member is provided in the direction perpendicular to the moving direction of the electrophotographic photosensitive member, wherein a third projection member extending from the proximity of the driving force receiving member to a side portion of a toner containing portion and having a substantially U-shaped configuration having a substantially semi-circular front end in a mounting direction of the process cartridge to said image forming apparatus is provided on an outer side of the process cartridge;

(b) driving force transmitting means for transmitting a driving force to the driving force receiving member;

(c) regulating means for regulating the third projection member;

(d) a laser shutter adapted to abut against the first projection member; and (e) an abutment member adapted to abut against the second projection member to open the protection member.

46. An image forming apparatus according to claim 45, further comprising a conductive member arranged at the other end portion opposite the one end portion of the electrophotographic photosensitive member where a gear as the driving force receiving member is provided in the direction perpendicular to the moving direction of the electrophotographic photosensitive member.

47. An image forming apparatus according to claim 46, wherein three conductive members are arranged side by side in a vertical direction, and an uppermost conductive member acts as a charge bias contact for receiving a charge bias, an intermediate conductive member acts as a developing bias contact for receiving a developing bias, and a lowermost conductive member acts as a toner remaining amount detection contact for informing of a toner remaining amount.

48. An image forming apparatus according to claim 45, wherein the process cartridge integrally incorporates therein charger means, developing means, or cleaning means as the process means, as a unit which can be removably mounted to said image forming apparatus.

49. An image forming apparatus according to claim 45, wherein the process cartridge integrally incorporates therein at least one of charger means, developing means, and cleaning means as the process means, as a unit which can be removably mounted to said image forming apparatus.

50. An image forming apparatus according to claim 45, wherein the process cartridge integrally incorporates therein at least developing means as the process means, as a unit which can be removably mounted to said image forming apparatus.

51. A process cartridge removably mountable onto an image forming apparatus, said process cartridge comprising:

an electrophotographic photosensitive drum;

a charging roller for charging said electrophotographic photosensitive drum;

a developing roller for developing a latent image formed on said electrophotographic photosensitive drum;

a cleaning blade for removing toner remaining on said electrophotographic photosensitive drum;

a driving force receiving member provided at one end portion of said electrophotographic photosensitive drum in a direction perpendicular to a moving direction thereof;

a protection member shiftable between a protection position to protect said electrophotographic photosensitive drum and a retract position where it is retracted from the protection position;

a first projection member provided on a side portion of a toner containing portion of said process cartridge and protruded in the direction perpendicular to the moving direction of said electrophotographic photosensitive drum more than said driving force receiving member, wherein said first projection member is provided on an outer side of said process cartridge and extends from the proximity of said driving force receiving member to a side portion of said toner containing portion, and has a substantially U-shaped configuration having a substantially semi-circular front end in a mounting direction of said process cartridge to the image forming apparatus;

a guide member protruded in the direction perpendicular to the moving direction of said electrophotographic photosensitive drum more than said first projection member;

a second projection member protruded in the moving direction of said electrophotographic photosensitive drum and arranged offset from a center of said electrophotographic photosensitive drum in the direction perpendicular to the moving direction thereof toward said one end portion where said driving force receiving member is provided, said second projection member opening a laser shutter provided in a main body of the image forming apparatus upon mounting of said process cartridge onto the main body of the image forming apparatus;

a third projection member protruded from said protection member in the direction perpendicular to the moving direction of said electrophotographic photosensitive drum and arranged at said one end portion where said driving force receiving member is provided in the direction perpendicular to the moving direction of said electrophotographic photosensitive drum, said third projection member engaging with a member provided in the main body of the image forming apparatus, upon mounting said process cartridge onto the main body of the image forming apparatus, to shift said protection member to the retract position;

a charge bias contact for receiving a charge bias from the main body of the image forming apparatus and for applying the charge bias to said charging roller upon mounting of said process cartridge onto the main body, a developing bias contact for receiving a developing bias from the main body and for applying the developing bias to said developing roller upon mounting of said process cartridge onto the main body, and a toner remaining amount alarming contact for alarming when a remaining toner amount decreases below a predetermined value, said charge bias contact, said developing bias contact, and said toner remaining amount alarming contact being arranged vertically adjacent a side of said process cartridge that is opposite a side at which said driving force receiving member is disposed in a direction orthogonal to a rotational direction of said electrophotographic photosensitive drum and being arranged adjacent to each other, and said charge bias contact, said developing bias contact, and said toner remaining amount alarming contact being arranged from top to bottom, respectively, in the vertical direction; and a conductive contact for earthing between said electrophotographic photosensitive drum and the main body of the image forming apparatus upon mounting of said process cartridge onto the main body, said conductive contact being arranged on the same side as said charge bias contact, said developing bias contact, and said toner remaining amount alarming contact in the direction orthogonal to the rotational direction of said electrophotographic photosensitive drum.

52. A process cartridge removably mountable onto an image forming apparatus having a drum shutter opening lever, a laser shutter, and a helical drive gear, said process cartridge comprising:

an electrophotographic photosensitive drum having a driven helical gear disposed at one longitudinal end thereof and protruded in a direction perpendicular to a rotational direction of said electrophotographic photosensitive drum, said driven helical gear being driven by the helical drive gear of the image forming apparatus when said process cartridge is removably mounted to the image forming apparatus;

a charging roller that abuts said electrophotographic photosensitive drum and charges said electrophotographic photosensitive drum;

a developing sleeve for developing a latent image formed on said electrophotographic photosensitive drum;

a cleaning blade for removing toner remaining on said electrophotographic photosensitive drum;

a drum shutter shiftable between a protection position to protect said electrophotographic photosensitive drum and a retract position where it is retracted from the protection position, said drum shutter being biased to the protection position by a shutter spring;

a guide surface provided on a side portion of a toner containing portion of said process cartridge and protruded in the direction perpendicular to the rotational direction of said electrophotographic photosensitive drum more than said driven helical gear, wherein said guide surface is provided on an outer side of said process cartridge and extends from a proximity of said driven helical gear to a side portion of said toner containing portion, and wherein said guide surface has a first guide surface extending in a direction from a rear portion of said process cartridge towards a front portion of said process cartridge, a substantially U-shaped second guide surface contiguous with said first guide surface and having a substantially semi-circular front end disposed in a mounting direction of said process cartridge to the image forming apparatus, and a third guide surface contiguous with said second guide surface and extending in a direction from said second guide surface towards the rear portion of said process cartridge;

two pairs of plate members protruded in the mounting direction of said process cartridge to the image forming apparatus and arranged offset from a center of said electrophotographic photosensitive drum in the direction perpendicular to the rotational direction thereof toward said one end portion where said driven helical gear is provided, wherein an inner pair of said two pairs of plates has a first height and open the laser shutter provided in a main body of the image forming apparatus when said process cartridge is mounted onto the main body of the image forming apparatus, and wherein an outer pair of said two pairs of plates has a second height less than said first height;

a drum shutter pin protruded from said drum shutter in the direction perpendicular to the rotational direction of said electrophotographic photosensitive drum and arranged at said one end portion where said driven helical gear is provided, said drum shutter pin engaging with the drum shutter opening lever provided in the main body of the image forming apparatus when said process cartridge is mounted onto the main body of the image forming apparatus such that said drum shutter is shifted to the retract position;

a charge bias contact that receives a charge bias from the main body of the image forming apparatus and applies the charge bias to said charging roller when said process cartridge is mounted onto the main body, a developing bias contact that receives a developing bias from the main body and applies the developing bias to said developing sleeve when said process cartridge is mounted onto the main body, and a toner remaining amount alarming contact that alarms when a remaining toner amount decreases below a predetermined value, said charge bias contact, said developing bias contact, and said toner remaining amount alarming contact being arranged vertically and being arranged adjacent a side of said process cartridge that is opposite a side at which said driven helical gear is disposed in a direction perpendicular to the rotational direction of said electrophotographic photosensitive drum and being arranged adjacent to each other, and said charge bias contact, said developing bias contact, and said toner remaining amount alarming contact being arranged respectively in a substantially vertical direction extending from a top portion to a bottom portion of said process cartridge; and a conductive contact that earths between said electrophotographic photosensitive drum and the main body of the image forming apparatus when said process cartridge is mounted onto the main body, said conductive contact being arranged on the same side of said process cartridge as said charge bias contact, said developing bias contact, and said toner remaining amount alarming contact in the direction perpendicular to the rotational direction of said electrophotographic photosensitive drum.

* * * * *

UNITED STATES PATENT AND TRADEMARK OFFICE

CERTIFICATE OF CORRECTION

PATENT NO. : 5,585,889

DATED : December 17, 1996

INVENTOR(S) : KAZUO SHISHIDO, ET AL.

It is certified that error appears in the above-indentified patent and that said Letters Patent is hereby corrected as shown below:

COLUMN 2:

Line 63, "a drum earth" should read --drum earthing--; and
Line 66, "earth" should read --earthing--.

COLUMN 3:

Line 56, "matters" should read --matter--.

COLUMN 4:

Line 34, "photo sensitive" should read --photosensitive--;
Line 51, "sheet" should read --sheets--; and
Line 58, "its" should read --the--.

COLUMN 5:

Line 41, "to" should read --in--; and
Line 60, "the overheat" should read --overheating--.

COLUMN 6:

Line 10, "roller" should read --rollers--;
Line 16, "rotated" should read --rotated in an--;
Line 44, "arrange" should read --arranged--;
Line 49, "min" should read --main--; and
Line 65, "pulled" should read --pulled toward--.

UNITED STATES PATENT AND TRADEMARK OFFICE

CERTIFICATE OF CORRECTION

PATENT NO. : 5,585,889

DATED : December 17, 1996

INVENTOR(S) : KAZUO SHISHIDO, ET AL.

It is certified that error appears in the above-indentified patent and that said Letters Patent is hereby corrected as shown below:

COLUMN 7:

Line 19, "changer" should read --changed--;
Line 20, "polarity same" should read --same polarity--;
Line 46, "format ion." should read --formation.--;
Line 47, "by" should read --for--; and
Line 48, "formation," should read --formations,--.

COLUMN 8:

Line 6, "retarded" should read --retracted--; and
Line 7, "FIGS." should read --FIG.--.

COLUMN 9:

Line 26, "portion" should read --portions--;
Line 29, "a" should read --an--:
Line 40, "the" (2nd. occ) should be deleted; and
Line 41, "longitudinal both" should read --both longitudinal--.

COLUMN 10:

Line 48, "is" should read --are--.

UNITED STATES PATENT AND TRADEMARK OFFICE

CERTIFICATE OF CORRECTION

PATENT NO. : 5,585,889

DATED : December 17, 1996

INVENTOR(S) : KAZUO SHISHIDO, ET AL.

It is certified that error appears in the above-indentified patent and that said Letters Patent is hereby corrected as shown below:

COLUMN 11:

Line 65, "material" (second occurrence) should read --materials--; and
Line 67, "each is" should read --are--.

COLUMN 12:

Line 3, "each is" should read --are--; and
Line 53, "portion" should read --portions--.

COLUMN 13:

Line 5, "both" should read --the--;
Line 47, "is interfered" should read --interferes--; and
olumn 14: Line 48, "large" should read --much--.

COLUMN 15:

Line 12, "from" should read --from a--; and
Line 49, "is" should read --are--.

COLUMN 16:

Line 8, "the" (1st. occ.) should be deleted;
Line 11, "deformed" should read --deformed by--;
Line 17, "10" should be deleted; and
Line 18, "1041," should read --104,--.

UNITED STATES PATENT AND TRADEMARK OFFICE

CERTIFICATE OF CORRECTION

PATENT NO. : 5,585,889

DATED : December 17, 1996

INVENTOR(S) : KAZUO SHISHIDO, ET AL.

It is certified that error appears in the above-indentified patent and that said Letters Patent is hereby corrected as shown below:

COLUMN 17:

Line 9, "by" should read --by the--; and
Line 51, "projections" should read --projection--.

COLUMN 18:

Line 43, "extends" should read --extend--.

COLUMN 19:

Line 21, "arrange," should read --arranged,--; and
Line 42, "where" should read --of--.

COLUMN 22:

Line 1, "protection" should read --projection--.

UNITED STATES PATENT AND TRADEMARK OFFICE

CERTIFICATE OF CORRECTION

PATENT NO. : 5,585,889 Page 5 of 5

DATED : December 17, 1996

INVENTOR(S) : KAZUO SHISHIDO, ET AL.

It is certified that error appears in the above-indentified patent and that said Letters Patent is hereby corrected as shown below:

COLUMN 30:

Line 14, "an" should be deleted;
Line 15, "an" should read --a--; and
Line 19, "an" should read --a--.

Signed and Sealed this

Twenty-sixth Day of August, 1997

*Attest:*

Bruce Lehman

BRUCE LEHMAN

*Attesting Officer*

*Commissioner of Patents and Trademarks*